US006024542A

United States Patent [19]

Phillips et al.

[11] Patent Number: 6,024,542

[45] **Date of Patent: *Feb. 15, 2000**

[54] PISTON PUMP AND METHOD OF REDUCING VAPOR LOCK

[75] Inventors: Benjamin A. Phillips, Benton Harbor, Mich.; Michael N. Harvey, DeSoto, Tex.

[73] Assignee: Phillips Engineering Co., St. Joseph, Mich.

[ * ] Notice: This patent is subject to a terminal disclaimer.

[21] Appl. No.: 08/728,612

[22] Filed: Oct. 10, 1996

Related U.S. Application Data

[63] Continuation-in-part of application No. 08/195,193, Feb. 14, 1994, Pat. No. 5,564,908.

[51] Int. Cl.[7] ..... F04B 1/04; F04B 35/04

[52] U.S. Cl. ..... 417/273; 417/415; 417/420; 91/492; 92/74; 92/140

[58] Field of Search ..... 417/273, 415, 417/420, 442, 493, 501; 91/492; 92/73, 74, 139, 140

[56] References Cited

U.S. PATENT DOCUMENTS

| | | | |
|---|---|---|---|
| 599,487 | 2/1898 | Bailey . | |
| 1,938,451 | 12/1933 | Floyd et al. | 416/415 |
| 2,324,291 | 7/1943 | Dodge . | |
| 2,345,125 | 3/1944 | Huber | 417/273 |
| 2,399,856 | 5/1946 | Coger . | |
| 2,429,426 | 10/1947 | Phillips et al. | 92/249 |
| 3,272,079 | 9/1966 | Bent | 92/240 |
| 3,310,000 | 3/1967 | Martin . | |
| 3,396,903 | 8/1968 | Oya . | |
| 3,420,184 | 1/1969 | Englesberg et al. . | |
| 3,572,981 | 3/1971 | Pearson et al. | 417/415 |
| 3,572,982 | 3/1971 | Kozdon | 417/423.7 |
| 3,584,975 | 6/1971 | Frohbieter . | |
| 3,639,087 | 2/1972 | Frohbieter . | |
| 3,817,661 | 6/1974 | Ingalls et al. | 417/902 |
| 4,143,995 | 3/1979 | Divisi . | |
| 4,399,669 | 8/1983 | Jacobs | 417/902 |
| 4,518,326 | 5/1985 | Peruzzi et al. . | |
| 4,673,337 | 6/1987 | Miller | 417/273 |
| 4,844,707 | 7/1989 | Kletschka . | |
| 5,030,065 | 7/1991 | Baumann . | |
| 5,033,940 | 7/1991 | Baumann . | |
| 5,127,805 | 7/1992 | Fallis et al. . | |
| 5,180,292 | 1/1993 | Abousabha et al. . | |
| 5,382,140 | 1/1995 | Eisenbacher et al. | 417/273 |
| 5,564,908 | 10/1996 | Phillips et al. | 417/273 |
| 5,614,276 | 3/1997 | Heidelberg et al. | 417/423.7 |
| 5,686,663 | 11/1997 | Spalding | 92/140 |
| 5,779,453 | 7/1998 | Nagayama et al. | 417/423.7 |

FOREIGN PATENT DOCUMENTS

| | | |
|---|---|---|
| 0 687 814 A2 | 12/1995 | European Pat. Off. . |
| 3141667 A1 | 10/1983 | Germany . |
| 3526882 A1 | 1/1987 | Germany . |
| 1564376 | 5/1990 | U.S.S.R. . |
| 2 272 732 | 5/1994 | United Kingdom . |

*Primary Examiner*—Charles G. Freay
*Attorney, Agent, or Firm*—Finnegan, Henderson, Farabow, Garrett & Dunner, L.L.P.

[57] ABSTRACT

A pump includes a housing defining a cavity, at least one bore, a bore inlet, and a bore outlet. The bore extends from the cavity to the outlet and the inlet communicates with the bore at a position between the cavity and the outlet. A crankshaft is mounted in supports and has an eccentric portion disposed in the cavity. The eccentric portion is coupled to a piston so that rotation of the crankshaft reciprocates the piston in the bore between a discharge position an intake position. The bore may be offset from an axis of rotation to reduce bending of the piston during crankshaft rotation. During assembly of the pump, separate parts of the housing can be connected together to facilitate installation of internal pumping components. Also disclosed is a method of reducing vapor lock by mixing vapor and liquid portions of a substance and introducing the mixture into a piston bore.

74 Claims, 8 Drawing Sheets

PISTON PUMP AND METHOD OF REDUCING VAPOR LOCK

This application is a continuation-in-part of U.S. patent application Ser. No. 08/195,193, filed on Feb. 14, 1994, now U.S. Pat. No. 5,564,908. The entire disclosure of U.S. patent application Ser. No. 08/195,193 is incorporated herein by reference.

GOVERNMENT RIGHTS

This invention was made with Government support under contract 86X-1 7497C awarded by the Oak Ridge National Laboratory for the Department of Energy. The Government has certain rights in this invention.

BACKGROUND OF THE INVENTION

1. Field of the Invention

This invention relates generally to piston pumps and methods of reducing vapor lock during pumping. In particular, the present invention relates to magnetically driven piston pumps capable of being used with absorption heat-pump and air conditioning systems.

2. Description of the Related Art

Recent attention has been given to the commercial viability of absorption heat-pump and air conditioning systems, and, in particular, to their use in residential and commercial heating and cooling applications. This increased attention has prompted developments in reducing the physical size of such systems, increasing the heating or cooling efficiencies of such systems, and increasing the service life of such systems. As improvements are made to the overall system, individual components are also receiving increased attention and refinements as such contribute to achieving further gains associated with the heat-pump system.

One component of heat-pump systems, the absorption system solution pump, has such a large number of operating requirements and design constraints, especially in smaller tonnage systems using ammonia/water, that few improvements have been made to it by prior artisans. Such solution pumps must be relatively small in size; be corrosion resistant, particularly to a solution of ammonia and water; hermetic; be able to provide a pressure lift of at least 300 psi; be able to pump liquid, vapor or both (and thus have a net positive suction head (NPSH) of zero); be free from wear even if exposed to abrasive particles; and ideally have a relatively long service lifetime of approximately 60,000 to 80,000 hours, using no normal lubricants. Although pumping devices are known which may provide one or more of these features or abilities, none are known which provide the complete combination of these features.

Service lifetime is one factor contributing to the commercial success of a heat pump. Service lifetime means the time period a pump should operate without maintenance or failures. When pumping devices are incorporated into larger packaged systems, such as absorption heat-pump systems, the pumping device should have a service life at least as long as the packaged system, as replacement of the pumping device often requires disassembly of the system. Competitive heat-pump systems are often expected to operate up to 20 years or 60,000 hours of operation without significant maintenance. Thus, the need exists for a pumping device which has a service life of at least 60,000 to 80,000 hours.

In addition, fluid pumps used in absorption heat-pump systems employing an ammonia and water solution are particularly susceptible to interior corrosion (or other chemical reactions) from prolonged exposure to the solution. Further, corrosion problems may arise when certain salts or other additives are placed in the ammonia and water systems to increase or decrease the range of system operating temperatures, or to operate the pumps at temperatures higher or lower than the normal 80°–130° F. range. Thus, the need exists for a pumping device which is relatively resistant to corrosion or other chemical reactions with the solutions of ammonia and water and potential additives.

In heat-pump systems utilizing an ammonia and water solution, the pumping device must have a net positive suction head (NPSH) equal to zero because the pump will commonly be exposed to an incoming solution at or near its boiling point. If the pressure of a liquid at the pump inlet is less than the NPSH of a normal pump, the solution will at least partially vaporize, causing destructive cavitation of the pump interior. Moreover, in the ammonia-water pumps, an NPSH of zero is necessary because the pump will be required to pump vapor along with the liquid during most of its operating lifetime. The pump must also be free from the possibility of leaks and must have high efficiency.

Piston pumps, such as the pump disclosed in U.S. Pat. No. 3,584,975, have been considered for use in absorption refrigeration systems, but most of these pumps have one or more drawbacks when they are used in heat pump systems. Many existing piston pumps are not durable enough to provide the continuous and frequent operation required in a heat pump system. For example, piston pumps are susceptible to wear and/or have parts that must be replaced or repaired periodically.

Complex manufacturing processes increase the cost of many piston pumps and make them too expensive to be used in affordable heat pump systems. In addition, many existing piston pumps undergo a condition known as vapor lock when they are used to pump liquids which are near boiling point during intake or which contain significant amounts of vapor.

SUMMARY OF THE INVENTION

Accordingly, the present invention is directed to pumps and methods of pumping that substantially obviate one or more of the limitations of the related art. In particular, the present invention provides a substantially maintenance-free, corrosion resistant, relatively low cost, hermetic pump capable of being used in absorption heat pump systems. Preferably, the pump is small in size, provides a pressure lift of over 300 psi, pumps both liquid and vapor, and has a long service lifetime.

To achieve these and other advantages and in accordance with the purposes of the invention, as embodied and broadly described herein, the invention includes a pump comprising a crankshaft having opposite end portions and an eccentric portion between the end portions, and a housing defining a cavity, an outlet, at least one bore extending between the cavity and the outlet, and at least one inlet communicating with the bore. The eccentric portion of the crankshaft is in the cavity and the end portions of the crankshaft are rotatably coupled to the housing. The bore is offset such that the bore axis does not intersect with the axis of rotation of the crankshaft. The pump also includes a piston having a base disposed in the cavity and a head disposed in the bore. The base of the piston is coupled to the eccentric portion of the crankshaft such that rotation of the eccentric portion in the cavity reciprocates the piston head in the bore to provide discharge from the bore through the outlet and intake to the bore through the inlet. A valve structure is disposed to open and close the outlet in response to movement of the piston head during the discharge and the intake.

In another aspect, the invention includes a pump having a housing defining a cavity, an outlet, at least one bore extending between the cavity and the outlet, and at least one inlet communicating with the bore intermediate the cavity and the outlet. A first support is at one end portion of the housing, and a second support is at another end portion of the housing.

Additionally, the present invention includes a method of reducing vapor lock during pumping of a substance having a liquid phase and a vapor phase. The method includes introducing the substance into a chamber so that a liquid portion of the substance settles in the chamber below a vapor portion of the substance, allowing the vapor portion of the substance to pass into an intake tube through a first opening in the intake tube, introducing the liquid portion of the substance into the intake tube through a second opening in the intake tube so that the liquid portion of the substance mixes uniformly with the vapor portion of the substance, passing the mixture of the vapor portion and liquid portion from the intake tube to a bore, and reciprocating a piston in the bore to pump the mixture from the bore.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
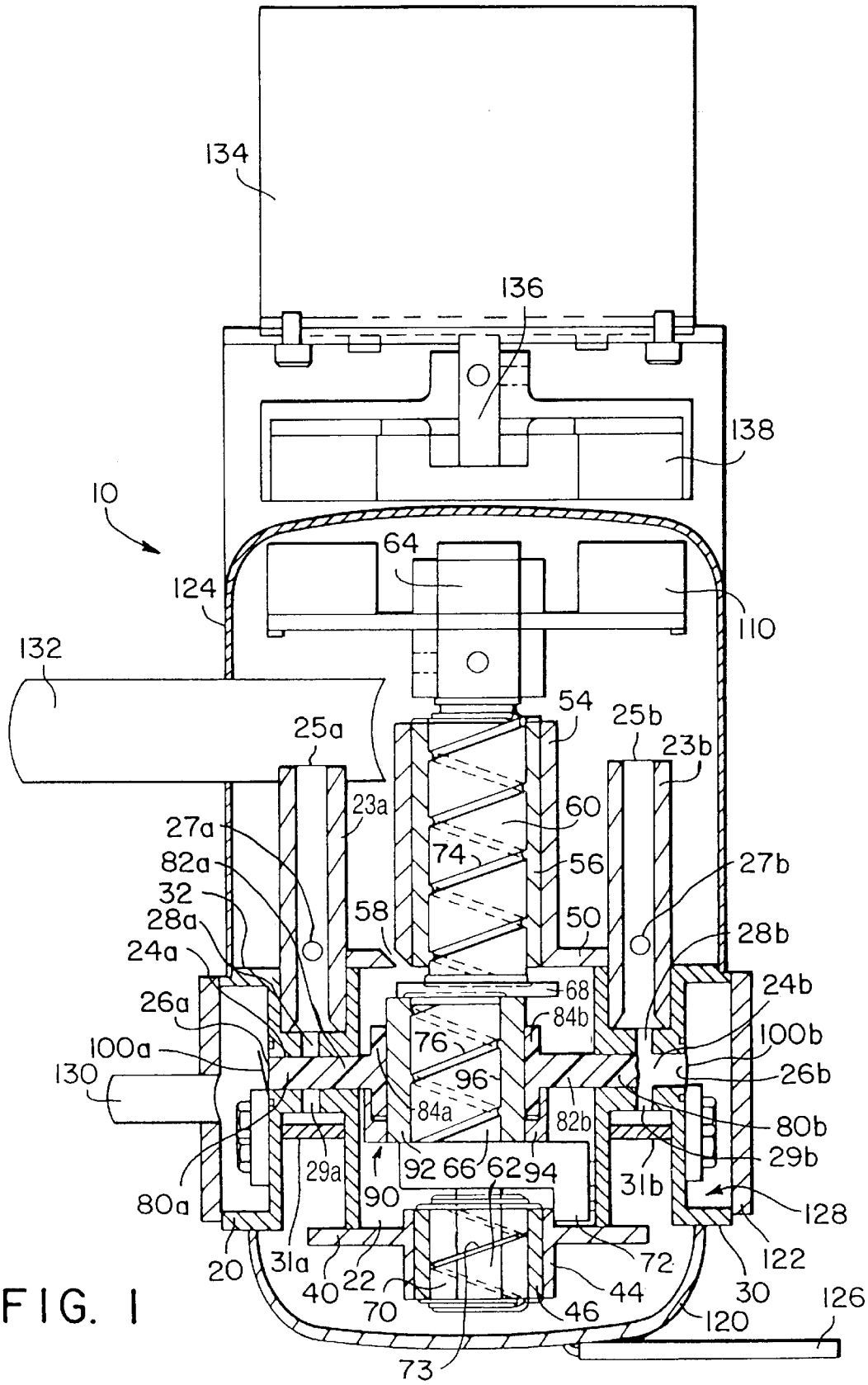
FIG. 1 is a partial cross sectional view of a first embodiment of the pump of the invention.

Reference will now be made in detail to the present preferred embodiments of the invention, examples of which are illustrated in the accompanying drawings. Wherever possible, the same reference numbers are used in the drawings and the description to refer to the same or like parts.

In accordance with the invention, there is provided a pump including a housing defining a cavity, an outlet, at least one bore extending between the cavity and the outlet, and at least one inlet communicating with the bore. As embodied herein and illustrated in FIG. 1, a pump 10 includes an interior housing 20 defining a cavity 22. Preferably, the housing 20 is formed of a material resistant to ammonia and water solutions or other substances pumped by pump 10. For example, the housing 20 is preferably made of a steel or cast iron.

Figure 3:
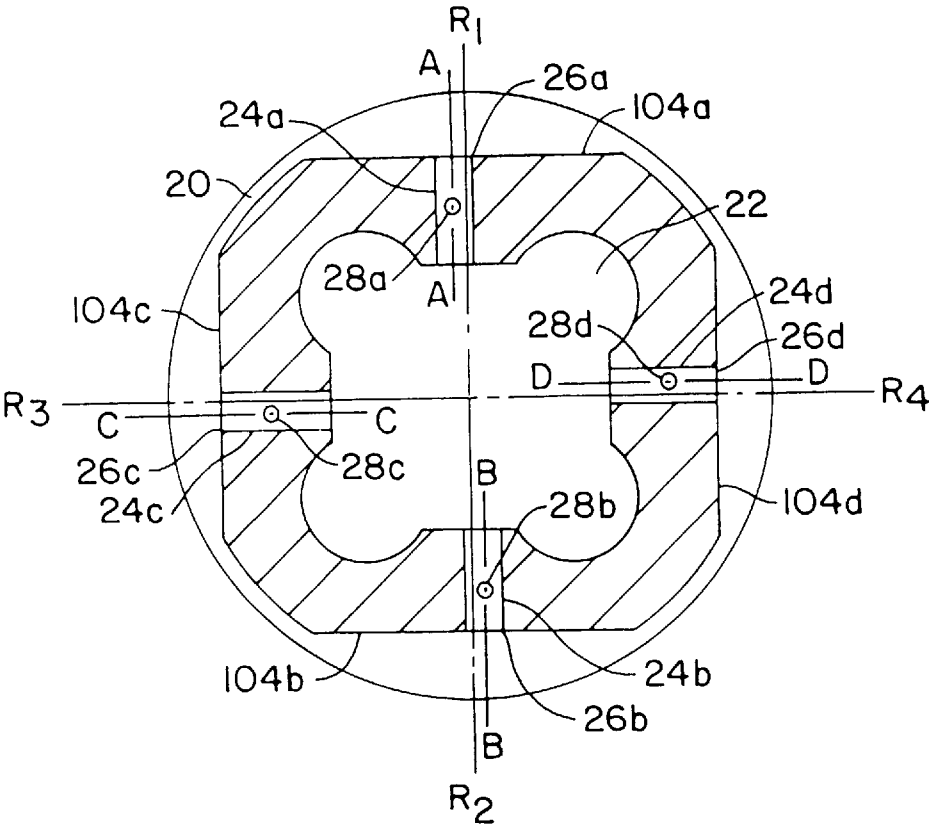
FIG. 3 is a cross sectional view of the housing taken along line 3—3 of FIG. 2 and includes lines representing axes of offset bores and radial lines extending from an axis of rotation of a crankshaft shown in FIG. 1.
Figure 2:
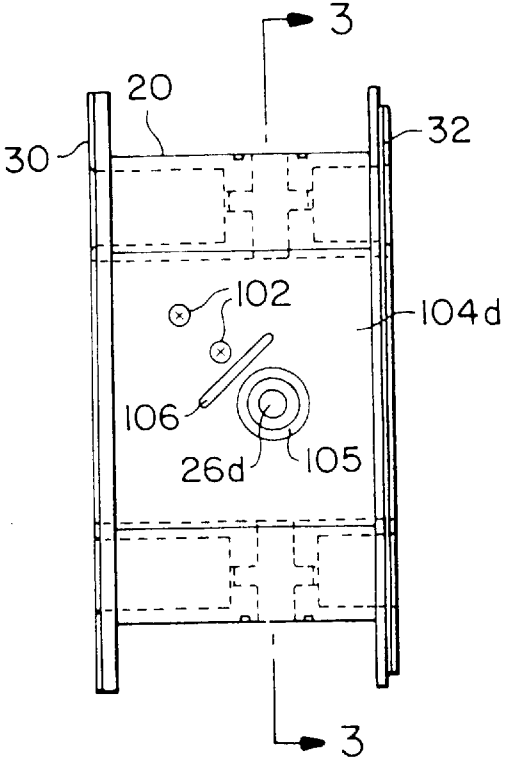
FIG. 2 is a side view of a housing shown in FIG. 1 and includes broken lines representing the internal structure of the housing.

As shown in FIGS. 2 and 3, the housing 20 includes bores 24*a*, 24*b*, 24*c*, and 24*d* extending from the cavity 22 and terminating at respective outlets 26*a*, 26*b*, 26*c*, and 26*d*. Each of the bores 24*a*, 24*b*, 24*c*, and 24*d* preferably includes at least one respective inlet 28*a*, 28*b*, 28*c*, and 28*d* formed in the housing 20 and spaced between the cavity 22 and the respective outlets 26*a*, 26*b*, 26*c*, and 26*d*. The inlets 28*a*, 28*b*, 28*c*, and 28*d* and outlets 26*a*, 26*b*, 26*c*, and 26*d* respectively communicate with the bores 24*a*, 24*b*, 24*c*, and 24*d* to allow pumped substance to enter and exit the bores 24*a*, 24*b*, 24*c*, and 24*d*.

As shown partially in FIG. 1, inlet tubes, such as inlet tubes 23*a* and 23*b*, extend from each of the inlets 28*a*, 28*b*, 28*c*, and 28*d*. The inlet tubes 23*a* and 23*b* include a respective open end 25*a* and 25*b* facing away from the housing 20 and an opening 27*a* and 27*b* spaced between the open end 25*a* and 25*b* and the housing 20. The opening 27*a*, 27*b* near the bottom of the inlet tubes 23*a* and 23*b* provides the maximum head of liquid stored in the pump 10 prior to flow into the bore inlets 28*a*, 28*b*, 28*c*, and 28*d*. Although the inlet tubes 27*a* and 27*b* are shown with only a single opening 27*a*, 27*b*, the inlet tubes could have a plurality of openings preferably located at the same height along the respective inlet tubes.

As described in more detail below, the inlet tubes limit occurrence of vapor lock by rapidly increasing the head of liquid at the inlet to the bores whenever inlet flow is slowed, as when a vapor lock attempts to start. In addition, the inlet tubes meter flow of liquid into the bore inlets 28*a*, 28*b*, 28*c*, and 28*d* to establish a relatively constant supply of solution to be pumped.

As partially illustrated in FIG. 1, auxiliary inlets, such as auxiliary inlets 29*a* and 29*b*, are optionally formed in the housing 20. The auxiliary inlets communicate with the respective bores 24*a*, 24*b*, 24*c*, and 24*d* and are in an opposed relationship with respect to bore inlets 28*a*, 28*b*, 28*c*, and 28*d*. Passages (not shown) are optionally formed in the housing 20 adjacent to the bores and inlets to allow fluid flow to the auxiliary inlets. In addition, plugs, such as plugs 31*a* and 31*b* shown in FIG. 1, may be placed in housing 20 and used to seal the auxiliary inlets from direct communication with an interior chamber formed by a casing for the pump 10.

Each of the bores 24*a*, 24*b*, 24*c*, and 24*d* has a longitudinal axis A—A, B—B, C—C, and D—D, shown in FIG. 3. Bores 24*a* and 24*b* form a first pair of opposed bores, and bores 24*c* and 24*d* form a second pair of opposed bores. As explained in more detail below, the bores 24*a*, 24*b*, 24*c*, and 24*d* are offset so that axes A—A and B—B of the first pair of opposed bores 24*a* and 24*b* are parallel to one another without intersecting and so that axes C—C and D—D of the second pair of opposed bores 24*c* and 24*d* are parallel to one another without intersecting.

Figure 4:
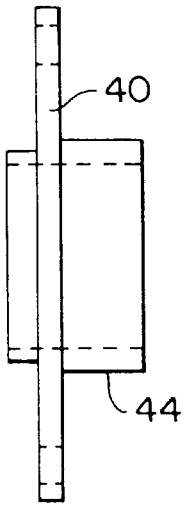
FIG. 4 is a side view of a first support shown in FIG. 1 and includes broken lines representing internal structure of the first support.

As illustrated in FIG. 1, a first support 40 is mounted to a first end portion 30 of the housing 20, and a second support 50 is mounted to a second end portion 32 of the housing 20. The first support 40 is shown in more detail in FIGS. 4 and 5, and the second support 50 is shown in more detail in FIGS. 6 and 7. During assembly of the pump 10, one or both of the first and second supports 40 and 50 are preferably connected to the housing 20 by means of welding or any known connectors, such as threaded bolts. Optionally, the first and second supports 40 and 50 could be formed integrally (in one piece) with the housing 20. However, connecting one or both of the first and second supports 40 and 50 to the housing 20 during assembly of the pump 10 provides certain advantages. For example, the first and second supports 40 and 50 can be connected to the housing 20 after formation of the cavity 22, bores 24*a*, 24*b*, 24*c*, and 24*d*, outlets 26*a*, 26*b*, 26*c*, and 26*d*, and inlets 28*a*, 28*b*, 28*c*, and 28*d* to simplify manufacture of the housing 20. In addition, the first and second supports 40 and 50 can be connected to the housing 20 after placing piston pump components in the cavity 22, bores 24*a*, 24*b*, 24*c*, and 24*d*, and the first and second supports 40 and 50 to facilitate assembly of the pump 10.

Figure 5:
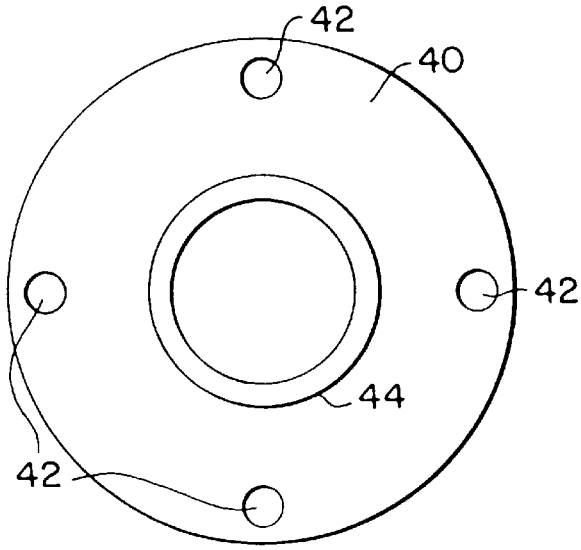
FIG. 5 is an end view of the first support shown in FIG. 4.
Figure 6:
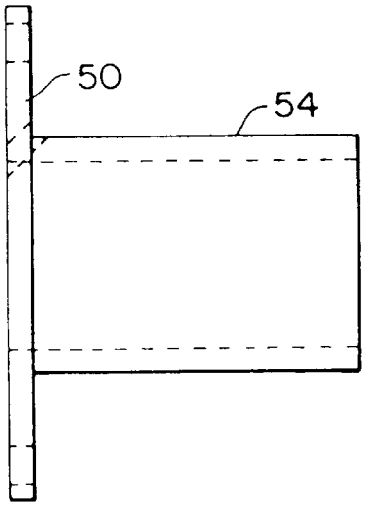
FIG. 6 is a side view of a second support shown in FIG. 1 and includes broken lines representing internal structure of the second support.
Figure 7:
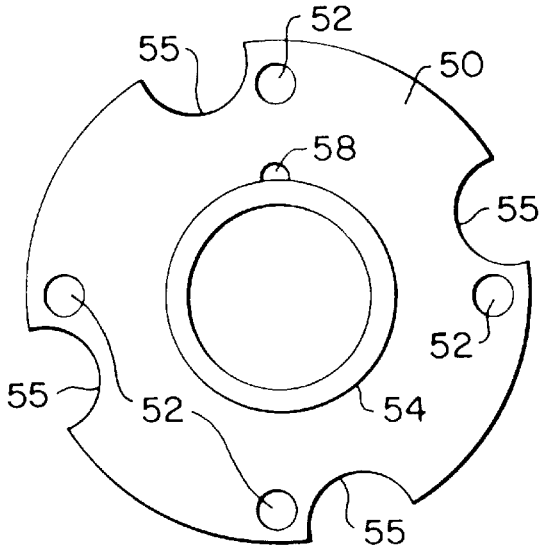
FIG. 7 is an end view of the second support shown in FIG. 6.

As shown in FIGS. 5 and 7, the first and second supports 40 and 50 preferably include respective alignment holes 42 and 52 for matching with alignment holes (not shown) in the first end portion 30 and second end portion 32 of housing 20 so that the housing 20 and first and second supports 40 and 50 can be aligned with alignment pins prior to connection. When the first and second supports 40 and 50 are connected to the housing 20, a cylindrical portion 44 of the first support 40 is preferably coaxial with a cylindrical portion 54 of the second support 50, as shown in FIG. 1. The inlet tubes, such as inlet tubes 23*a* and 23*b* shown in FIG. 1, fit within rounded flange grooves 55 shown in FIG. 7.

In accordance with the invention, a crankshaft has opposite end portions rotatably coupled to the housing and an eccentric portion in the cavity. As shown in FIG. 1, a crankshaft 60, shown in more detail in FIGS. 8 and 9, includes a first end portion 62 mounted for rotation in the cylindrical portion 44 of the first support 40 and a second end portion 64 mounted for rotation in the cylindrical portion 54 of the second support 50. The crankshaft 60 also includes at least one eccentric portion 66 located between the crankshaft end portions 62 and 64 and in the cavity 22.

As illustrated in FIG. 1, the crankshaft 60 preferably includes a thrust bearing/counterweight 68 between the eccentric portion 66 and second crankshaft end portion 64. In addition, a shaft sleeve 70 and a main counterweight/thrust bearing 72 are preferably mounted onto the first crankshaft end portion 62. Optionally, the shaft sleeve 70 and main counterweight/thrust bearing 72 may be formed unitarily with the crankshaft 60. The crankshaft 60 is preferably formed of a hardened steel having a nitrided surface, a hardened stainless steel, or a ceramic.

As shown in FIG. 1, a first cylindrical bearing bushing or sleeve 46 is preferably positioned in the cylindrical portion 44 between the first support 40 and shaft sleeve 70. In addition, a second bearing bushing or sleeve 56 is preferably positioned in the cylindrical portion 54 between the second support 50 and the second crankshaft end portion 64. One or both of the bearing sleeves 46 and 56 act as journal bearings and/or thrust bearings for the crankshaft 60. Preferably, the first and second bearing sleeves 46 and 56 are attached to the respective cylindrical portions 44 and 54 with a set screw or an appropriate adhesive.

Figure 8:
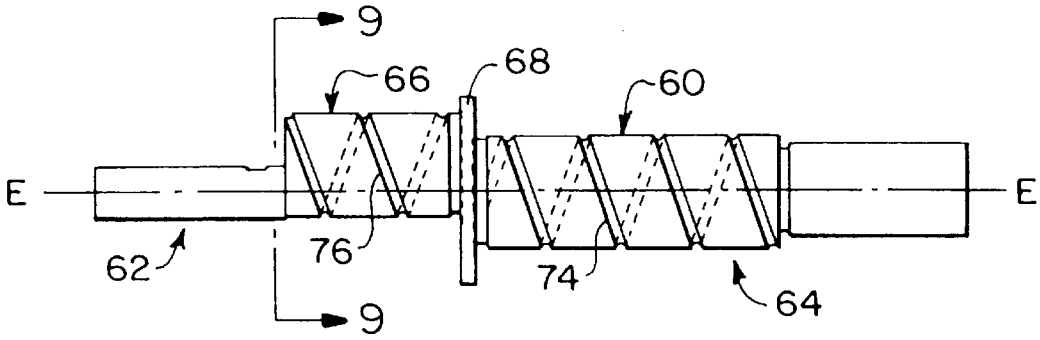
FIG. 8 is a side view of the crankshaft shown in FIG. 1.
Figure 9:
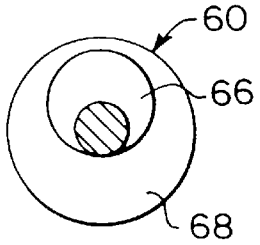
FIG. 9 is a cross sectional view taken along line 9—9 of FIG. 8.

During operation of the pump 10, the crankshaft 60 rotates about its axis of rotation E—E, shown in FIG. 8. The eccentric portion 66 is offset from the axis of rotation E—E so that the eccentric portion 66 moves in a circular path of motion in the cavity 22 when the crankshaft 60 rotates. The thrust bearing/counterweight 68 and separate main counterweight/thrust bearing 72 are offset from the axis of rotation E—E in an opposite direction from the eccentric portion 66 to place the center of mass of the crankshaft 60 and a coupling structure 90, shown in FIGS. 1, 10, 13, and 14, along the crankshaft axis of rotation E—E. This minimizes vibration while the crankshaft 60 rotates.

To reduce friction during rotation of the crankshaft 60, especially during initial start up of pump 10, the first and second bearing sleeves 46 and 56 are preferably formed of a lubricious material. For example, the first and second bearing sleeves 46 and 56 are preferably formed of graphite, carbon, carbon graphite, or a suitable ceramic.

Preferably, friction is also reduced by conveying liquid to be pumped along portions of the crankshaft 60 to provide what is commonly known as a hydrodynamic bearing film. As shown in FIGS. 1 and 8 the shaft sleeve 70, second crankshaft end portion 64, and crankshaft eccentric portion 66 each preferably include an external helical groove 73, 74, and 76. During rotation of the crankshaft 60, the helical grooves 73, 74, and 76 convey fluid stored in a casing of pump 10 respectively between the shaft sleeve 70 and first bearing sleeve 46, between the second crankshaft end portion 64 and the second bearing sleeve 56, and between the eccentric portion 66 and a piston coupling structure 90, described below. The fluid conveyed by the helical grooves 73, 74, and 76 reduces friction and provides cooling while lubricating bearing surfaces. As shown in FIGS. 1 and 7, the second support 50 preferably includes one or more passages, such as passage 58 for directing fluid to one end of the helical groove 74. The first support 40 may also include a passage similar to passage 58.

In accordance with the invention, a piston has a head disposed in the bore and a base coupled to the eccentric portion of the crankshaft. As partially shown in FIG. 1, pistons 80*a*, 80*b*, 80*c*, and 80*d*, shown in FIGS. 10–12, have heads 82*a*, 82*b*, 82*c*, and 82*d* disposed in respective bores 24*a*, 24*b*, 24*c*, and 24*d* and bases 84*a*, 84*b*, 84*c*, and 84*d* disposed in the cavity 22. Coupling structure 90, shown in FIGS. 1, 10, 13, and 14, couples the piston bases 84*a*, 84*b*, 84*c*, and 84*d* to the crankshaft eccentric portion 66 so that rotation of the crankshaft 60 reciprocates the piston heads 82*a*, 82*b*, 82*c*, and 82*d* in the respective bores 24*a*, 24*b*, 24*c*, and 24*d* between an intake position (See piston 80*b* in FIG. 1.), where the inlets 28*a*, 28*b*, 28*c*, and 28*d* are open to allow flow of substances into the bores 24*a*, 24*b*, 24*c*, and 24*d*, and a discharge position (See piston 80*a* in FIG. 1.), where the inlets 28*a*, 28*b*, 28*c*, and 28*d* are closed by the piston heads 82*a*, 82*b*, 82*c*, and 82*d* and substances are discharged from the outlets 26*a*, 26*b*, 26*c*, and 26*d*.

When the pistons heads 82*a*, 82*b*, 82*c*, and 82*d* reach the discharge position, they have preferably traveled all the way to the outlets 26*a*, 26*b*, 26*c*, and 26*d* to discharge all or substantially all of the liquid from the bores 24*a*, 24*b*, 24*c*, and 24*d*. This substantially decreases the likelihood of having liquid in the bores 24*a*, 24*b*, 24*c*, and 24*d* that could vaporize and create a vapor lock.

Preferably, the pistons 80*a*, 80*b*, 80*c*, and 80*d* are formed of a relatively light weight plastic material having low friction, low wear, and compatibility with pumped substances, such as ammonia and water mixtures. Preferred materials for the pistons 80*a*, 80*b*, 80*c*, and 80*d* are RULON or teflon filled with molybdenum disulfide. To absorb pressure spikes that may occur in the bores 24*a*, 24*b*, 24*c*, and 24*d* during movement to the discharge position, the pistons 80*a*, 80*b*, 80*c*, and 80*d* are preferably made of a plastic capable of slight elastic compression.

Figure 12:
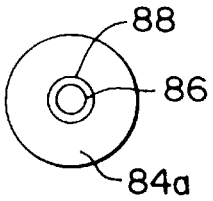
FIG. 12 is a top view of the piston shown in FIG. 11.
Figure 13:
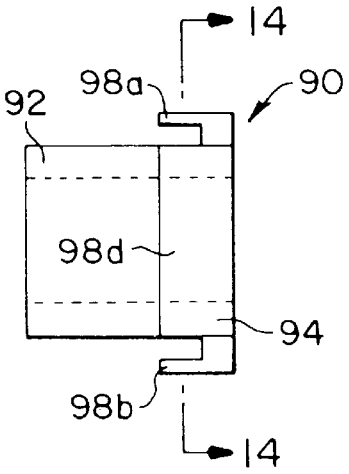
FIG. 13 is a side view of the coupling structure shown in FIGS. 1 and 10.
Figure 14:
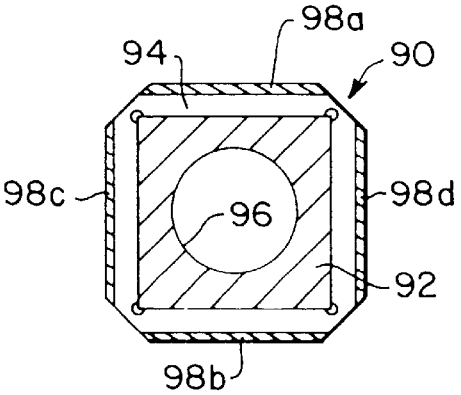
FIG. 14 is a cross sectional view taken along line 14—14 of FIG. 13.

As shown in FIG. 12, the piston heads 82*a*, 82*b*, 82*c*, and 82*d* include an annular groove 86 in a top surface thereof. The annular groove 86 allows an annular outer portion 88 of the piston heads 82*a*, 82*b*, 82*c*, and 82*d* to flare out and expand in the respective bores 24*a*, 24*b*, 24*c*, and 24*d* in response to the pressure experienced during pumping. This expansion improves sealing between the piston heads 82*a*, 82*b*, 82*c*, and 82*d* and the respective bores 24*a*, 24*b*, 24*c*, and 24*d* while substances are being pumped. The sealing provided by the expansion of annular outer portion 88 preferably eliminates the need for O-rings or piston rings.

As shown in FIGS. 1, 10,13, and 14, the coupling structure 90 preferably includes a slider block 92 and a retractor or retainer 94. In the preferred embodiment, the slider block 92 and retainer 94 are separate components joined together by heat shrinking the retainer 94 onto the slider block 92—heating the retainer 94 so that it expands, placing it around a portion of the slider block 92, and then allowing it to cool and contract so that it grips the slider block 92. However, the slider block 92 and retainer 94 may be formed unitarily from materials, such as ceramics, steel alloys, or plastics.

The slider block 92 is preferably formed of a lubricious material, such as carbon graphite or ceramic, such as silicon nitride or silicon carbide. Optionally, the slider block 92 may be coated with a lubricious material and/or have a hardened carbide outer surface such as Purabide of Pure Carbon. To minimize friction and wear, the material selected for the slider block 92 is preferably compatible with the material selected for the pistons 80*a*, 80*b*, 80*c*, and 80*d*. As shown in FIG. 1, the crankshaft eccentric portion 66 passes through a crankshaft bore 96 formed in the slider block 92 and is rotatable within the crankshaft bore 96. Preferably, the slider block 92 is assembled onto the crankshaft 60 before the shaft sleeve 70 and main counterweight/thrust bearing 72 are attached to the crankshaft 60. To reduce friction and provide cooling when the crankshaft 60 rotates, the helical groove 76 in the eccentric portion 66 conveys fluid into the crankshaft bore 96 between the slider block 92 and eccentric portion 66.

Figure 10:
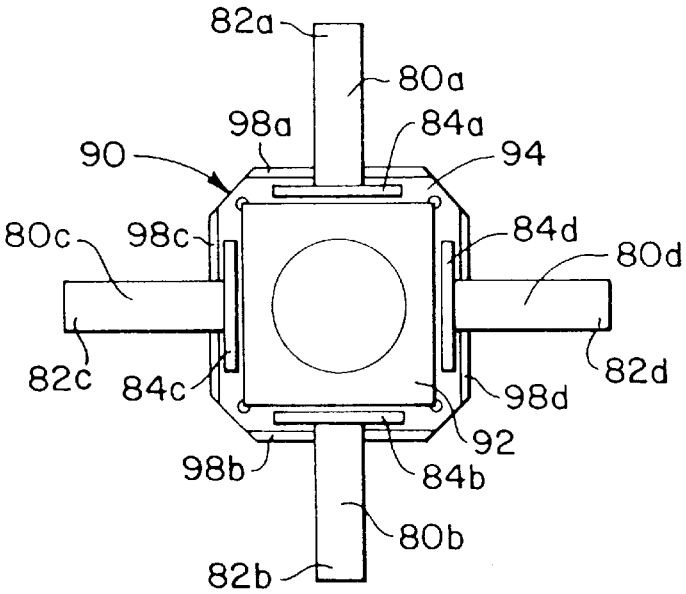
FIG. 10 is a side view of pistons coupled to a coupling structure shown in FIG. 1.
Figure 11:
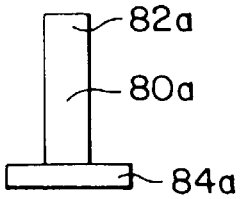
FIG. 11 is a side view of one of the pistons shown in FIGS. 1 and 10.

The retainer 94 is preferably formed of stainless steel and includes ledges 98*a*, 98*b*, 98*c*, and 98*d* spaced from outer surfaces of the slider block 92. As shown in FIGS. 1 and 10, portions of the piston bases 84*a*, 84*b*, 84*c*, and 84*d* slidably fit in slots formed between the ledges 98*a*, 98*b*, 98*c*, and 98*d* and the outer surfaces of the slider block 92.

When the crankshaft 60 rotates about its longitudinal axis E—E, the crankshaft eccentric portion 66 rotates in the crankshaft bore 96, and the coupling structure 90 moves in a circular path in the cavity 22 without rotating. As the coupling structure 90 moves in its circular path, the pistons 80*a*, 80*b*, 80*c*, and 80*d* reciprocate in the bores 24*a*, 24*b*, 24*c*, and 24*d* between an intake stroke and a discharge stroke. During the intake stroke, the retainer ledges 98*a*, 98*b*, 98*c*, and 98*d* pull the pistons bases 84*a*, 84*b*, 84*c*, and 84*d* and their piston heads away from the bore outlets 26*a*, 26*b*, 26*c*, and 26*d*. During the discharge stroke, the slider block 92 pushes the pistons bases 84*a*, 84*b*, 84*c*, and 84*d* and piston heads toward the bore outlets 26*a*, 26*b*, 26*c*, and 26*d*.

When the pistons 80*a*, 80*b*, 80*c*, and 80*d* reciprocate, outer surfaces of the slider block 92 slide relative to the respective piston bases 84*a*, 84*b*, 84*c*, and 84*d* while respective portions of the piston bases 84*a*, 84*b*, 84*c*, and 84*d* are retained in the slots formed between the ledges 98*a*, 98*b*, 98*c*, and 98*d* and the outer surfaces of the slider block 92. This sliding takes place in a direction perpendicular to the respective bore axes A—A, B—B, C—C, and D—D. To reduce friction as the piston bases 84*a*, 84*b*, 84*c*, and 84*d* slide, the outer surfaces of the slider block 92 and inner surfaces of the ledges 98*a*, 98*b*, 98*c*, and 98*d* are preferably lubricious. As shown in FIG. 12, the pistons bases 84*a*, 84*b*, 84*c*, and 84*d* are preferably circular. This shape allows the pistons bases 84*a*, 84*b*, 84*c*, and 84*d* to rotate on the slider block 92 during sliding and thereby reduces the likelihood of the pistons bases 84*a*, 84*b*, 84*c*, and 84*d* wearing unevenly. In addition, the round shape for the piston bases 84*a*, 84*b*, 84*c*, and 84*d* makes them less expensive than square shaped bases and easier to mount in the coupling structure 90.

Although FIG. 3 does not show the crankshaft 60, it shows the position of the crankshaft longitudinal axis E—E in housing 20 when the crankshaft 60 is rotatably mounted in the first and second supports 40 and 50. As shown in this figure, the bores 24*a*, 24*b*, 24*c*, and 24*d* are offset such that the bore axes A—A, B—B, C—C, and D—D lack intersection with the crankshaft rotational axis E—E. More specifically, the bores 24*a*, 24*b*, 24*c*, and 24*d* are offset so that each of the bore axes A—A, B—B, C—C, and D—D are generally parallel to (and lack intersection with) a respective radial line R1, R2, R3, and R4 extending from the crankshaft rotational axis E—E in a plane parallel the crankshaft rotational axis E—E (in the plane taken along line 3—3 of FIG. 2). This offset spacing of the bores 24*a*, 24*b*, 24*c*, and 24*d* reduces the likelihood that pistons 80*a*, 80*b*, 80*c*, and 80*d* will undergo excessive stress and become deformed after a long period of use of the pump 10.

In FIG. 3, each of the bore axes A—A, B—B, C—C, and D—D are shown spaced from the respective radial lines R1, R2, R3, and R4 in a counter-clockwise direction, and the crankshaft 60 rotates in the clockwise direction. When the pistons 80*a*, 80*b*, 80*c*, and 80*d* are in their discharge strokes, this offest causes the crankshaft eccentric portion 66 and coupling structure 90 to be closer to the bore axes A—A, B—B, C—C, and D—D than they would if the bores 24*a*, 24*b*, 24*c*, and 24*d* were not offset. Consequently, bending moments acting on the pistons 80*a*, 80*b*, 80*c*, and 80*d* are reduced. In addition, the piston heads 82*a*, 82*b*, 82*c*, and 82*d* are moved in the bores 24*a*, 24*b*, 24*c*, and 24*d* closer to the bore outlets 26*a*, 26*b*, 26*c*, and 26*d* before increased sliding friction forces are applied to the piston bases 84*a*, 84*b*, 84*c*, and 84*d* during crankshaft 60 rotation.

The inventors have found that when solution pumps have bore axes coaxial with respective radial lines, similar to radial lines R1, R2, R3, and R4, pistons may be bent during operation under certain conditions.

In FIG. 3, as the crankshaft 60 and the coupling structure 90 rotate clockwise around the crankshaft axis of rotation E—E, the circular motion of the coupling structure 90 moves the pistons 80*a*, 80*b*, 80*c*, and 80*d* in and out of their respective bores 24*a*, 24*b*, 24*c*, and 24*d*. When the eccentric portion 66 and coupling structure 90 are at the 12 o'clock position in FIG. 3, the piston head 82*a* in bore 24*a* is at the bore outlet 26*a*, while the piston 80*b* in bore 24*b* is fully retracted to open intake port 28*b* (See FIG. 1.). Because each piston 80*a*, 80*b*, 80*c*, and 80*d* is moved linearly by the rotational motion of the coupling structure 90, its reciprocating velocity is essentially sinusoidal. When the coupling structure 90 passes through the 12 o'clock position (shown in FIG. 1), the pistons 80*a* and 80*b* in bores 24*a* and 24*b* have zero velocity, and the pistons 80*c* and 80*d* in bores 24*c* and 24*b* are at their maximum velocities.

As the crankshaft 60 continues to rotate clockwise from the 12 o'clock position, the piston 80*b* in bore 24*b* starts its pumping stroke. If bore 24*b* has been filled with liquid during the preceding intake stroke, the pressure in the bore 24*b* will rise to a discharge pressure when the piston 80*b* in bore 24*b* closes off intake port 28*b*. A discharge valve structure 100*b*, shown in FIG. 1, will then open, and because the piston 80*b* will still be at a low velocity, a large pressure pulse will not occur.

If the fluid being pumped is a two phase mixture of liquid and its vapor, the piston 80*b* compresses the mixture, and the liquid portion absorbs the vapor portion with only a slight pressure rise in the bore. When the last bubble of vapor is absorbed, the crankshaft eccentric portion 66 may have rotated to about the three o'clock position in FIG. 3. At this instant, the piston 80*b* may be at its maximum velocity while the liquid has remained static because the valve 100*b* has been kept shut by discharge pressure. The sudden impact resulting upon absorption of the vapor can cause a pressure spike of over 1,000 psi. The force of the impact tends to move the piston 80*b* backward in the bore 24*b* along the bore axis B—B while the momentum of the crankshaft eccentric portion 66 and coupling structure 90 cause a counter force which is out of alignment with the bore axis B—B. These two forces tend to bend the portion of the piston 80*b* that is not extending in the bore 24*b*. Offsetting the bores places them closer to alignment with the average direction of force exerted by the crank eccentric portion 66 and coupling structure 90, and limits the likelihood of piston bending by reducing bending moments acting on the pistons.

In accordance with the invention, a valve structure is disposed to open and close the bore outlet in response to movement of the piston to the discharge position. As embodied herein and shown in FIG. 1, valve structures 100*a* and 100*b* are secured to housing 20 over outlets 26*a* and 26*b* of bores 24*a* and 24*b*. (Valve structures (not shown) similar in structure and function to valve structures 100*a* and 100*b* are also secured over outlets 26*c* and 26*d* of bores 24*c* and 24*d*.) Preferably, valve structures 100*a* and 100*b* are flexible resilient leaf valves or reed valves formed from thin strips of Swedish, stainless, or carbon steel, such as those used in refrigeration and air conditioning compressors operating at similar speeds. To substantially prevent backflow of pumped liquids, valve structures 100*a* and 100*b* are biased to close outlets 26*a* and 26*b* during the intake strokes of the pistons 80*a* and 80*b*. Fluid pressure generated during movement of the piston heads 82*a* and 82*b* toward their discharge position moves the valve structures 1 00*a* and 1 00*b* away from the outlets 26*a* and 26*b* to allow for one-way liquid discharge from the outlets 26*a* and 26*b*.

Preferably, the pump 10 is capable of operating at crankshaft speeds of approximately 3600 rpm. This speed requires valve structures 100*a* and 100*b* to be able to flex away from the outlets 26*a* and 26*b* sixty times per second. This relatively high rate of flex subjects them to potential fatigue failure. The valve structures 100*a* and 100*b* should therefore be constructed of proper materials and designed with the proper dimensions to operate at strains well below the endurance limit. Preferably, the valve structures 100*a* and 100*b* have a relatively small mass and rapid opening and closing times to help relieve any high pressure spikes occurring in the bores 24*a*, 24*b*, 24*c*, and 24*d* and to prevent back flow at the start of the intake stroke.

Valve structures 100*a* and 100*b* are preferably fixed to the housing 20 with rivets or bolts threaded into fastener holes 102, shown in FIG. 2. Fastener holes 102 are formed in the housing 22 and situated to orient the valve structures at any preferred angle relative to the housing 20. Preferably, external surface portions 104*a*, 104*b*, 104*c*, and 104*d* shown in FIG. 3 around the periphery of the bore outlets 26*a*, 26*b*, 26*c*, and 26*d* are machined and ground so that they are flat and smooth, not curved like the rest of the external surface of housing 20. As shown in FIG. 2, the external surface portion 104*d* includes a circular groove 105 formed around outlet 26*d* and a straight slot 106 formed between the fastener holes 102 and outlet 26*d*. The circular groove 104 and slot 106 combined with the movement of the valves serve to produce liquid turbulence and paths for dispersing particulate matter which would otherwise obstruct the seating of the valve structure over the outlet.

The valve structures may also include valve stops for limiting the distances the valve structures flex away from the housing 22. For example, the valve stops may be the same as the valve stops disclosed in the above-mentioned parent application (Ser. No. 08/195,193).

In accordance with the invention, a magnetic member is coupled to the crankshaft to couple the crankshaft magnetically with an external magnetic field capable of rotating the crankshaft. As shown in FIG. 1, magnetic member 110 is preferably coupled to the second end portion 64 of the crankshaft 60 so that an external magnetic field can magnetically couple with the magnetic member 110 and rotate the crankshaft 60. When the pump 10 is used to pump certain substances, a magnetic drive coupling is preferred over a direct coupling so that the motor or other drive source for rotating the crankshaft 60 can be hermetically isolated from the interior of the pump 10. For example, solutions of ammonia in water, especially those including inhibitors, rapidly corrode many materials, such as copper, aluminum, brass, etc., which are commonly used in motors of hermetic compressors in electric heat pumps, air conditioners, etc. for operation with chlorofluorocarbon, hydrochlorofluorocarbon and hydrofluorocarbon refrigerants. The pump 10 is preferably made of carbon steels and other materials that are not affected by ammonia/water and the inhibitors. In addition, the magnetic member 110 is made of materials, such as ceramic, ferrite or metals which are not affected by ammonia, water, or inhibitors.

Preferably, the pump 10 is made to be hermetic by locating at least a portion of the housing 20 and all of the internal components, including the crankshaft 60 and magnetic member 110, in a welded hermetic casing including a first cover 120, second cover 122, and third cover 124. As shown in FIG. 1, the first cover 120 is circumferentially welded to the first end portion 30 of the housing 22 to enclose a bottom portion of the pump 10. The first cover 120 preferably includes one or more mounting brackets 126 for mounting the pump 10 so that the first crankshaft end portion 62 is below the second crankshaft end portion 64.

The second cover 122 is circumferentially welded to the first housing end portion 30 and the second housing end portion 32 to form an annular discharge chamber 128 surrounding the bore outlets 26*a*, 26*b*, 26*c*, and 26*d*. The discharge chamber 128 communicates with a discharge tube 130 attached to an opening in the second cover 122 so that pumped substances can be removed from the discharge chamber 128 and directed toward the high pressure section of a heat pump, when pump 10 is used in a heat pump system.

The third cover 124 is circumferentially welded to the second housing end portion 32 to enclose the magnetic member 110 and second crankshaft end portion 64. As shown in FIG. 1, an intake tube 132 is attached to an opening in the third cover 124 so that substances can enter an interior portion of the pump 10 and be stored temporarily in a chamber formed by the first cover 120, third cover 124, and the housing cavity 22 before being pumped. Preferably, the third cover 124 is made of a non-magnetic material, such as stainless steel, which has minimal effects on the magnetic coupling with the magnetic member 110.

As shown in the embodiment of FIG. 1, a motor 134 having a rotatable drive shaft 136 is mounted to the exterior of the third cover 124. The motor 134 is preferably a two-pole motor to allow for high speed operation. A driving magnet 138 is directly coupled to the drive shaft 136 and magnetically coupled to the magnetic member 110 with a slip free engagement. Preferably, the driving magnet 138 and magnetic member 110 have three pairs of north and south poles magnetically coupled together. When the motor 134 is energized to rotate the drive shaft 136, the magnetic coupling between the driving magnet 138 and magnetic member 110 transmits rotation to the crankshaft 60. Although an axial magnetic coupling is shown in the embodiment of FIG. 1, radial magnetic couplings can also be used. In addition, the pump 10 may include a decoupling detector (not shown) for detecting whether the driving magnet 138 or magnetic member 110 is rotating out of sync or not rotating at all.

Figure 15:
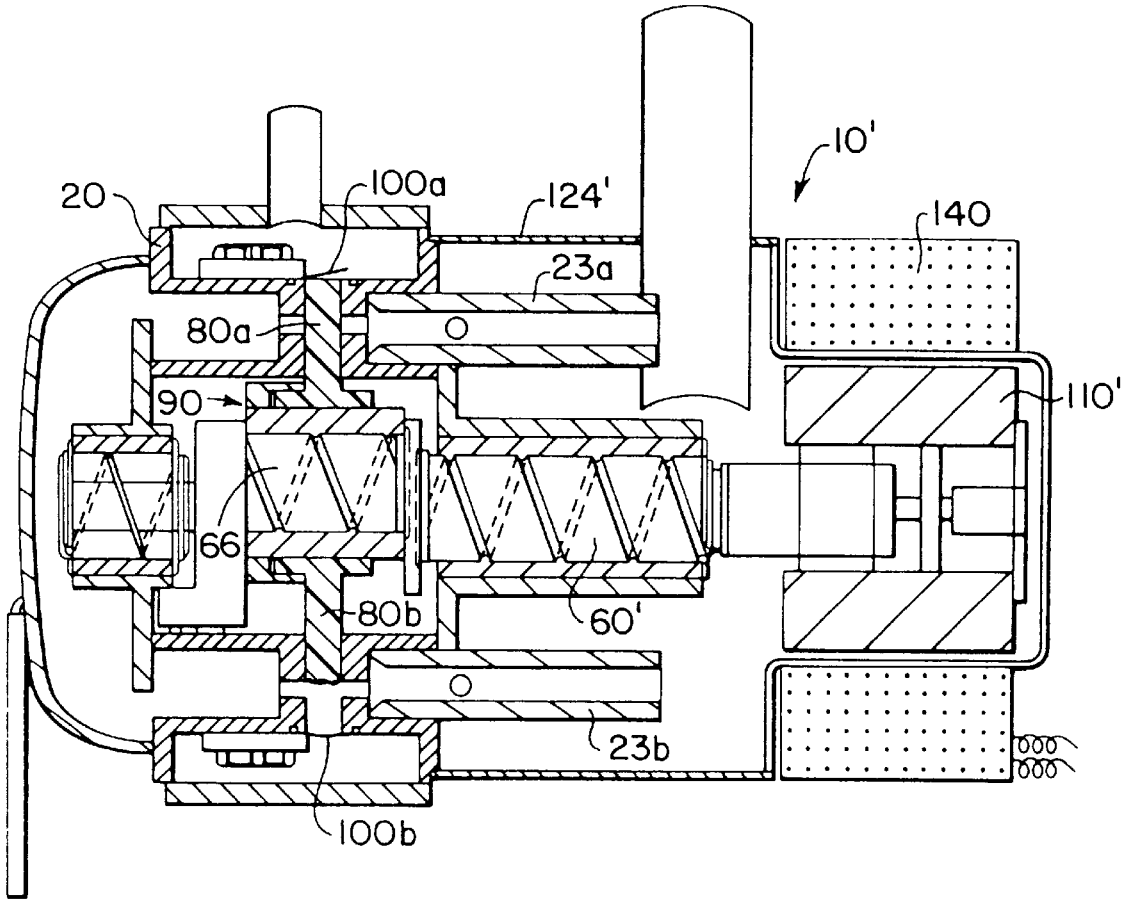
FIG. 15 is a partial cross sectional view of a second embodiment of the pump.

FIG. 15 shows a second embodiment of the invention including a pump 10' similar to the pump 10 shown in FIG. 1. The pump 10' includes a radially arranged magnetic member 110' and a third cover 124' cover covering the magnetic member 110', crankshaft 60', and other internal components of the pump 10'. To rotate the magnetic member 110' and crankshaft 60', the pump 10' includes an electromagnetic stator 140 press fit or rigidly mounted onto the third cover 124'. The electromagnetic stator 140 includes windings capable of generating rotating magnetic fields when they are energized. The drive system for the electromagnetic stator 140 may be a Hall Effect or other three phase type and the magnetic coupling may be radial, as shown in FIG. 15, or axial. The electromagnetic stator 140 eliminates the need for a driving magnet, motor rotor, and motor shaft, costs less than an external motor system, and reduces the likelihood of decoupling.

Vapor-lock is a common consequence when attempting to pump any boiling liquid, or such a liquid and its vapor. When vapor-lock occurs in normal pumps, it is usually necessary to turn off the pump, let it cool down, refill with liquid, and then be restarted. The controls on a heat pump system will do so if necessary. However, it is preferred to stop vapor lock before it reaches this state.

In accordance with the invention, there is also provided a method of reducing vapor lock. This method is explained below by explaining operation of the embodiments described above. However, it should be understood that the method of the invention is not limited to the structure disclosed herein.

In FIG. 1, a substance having at least a liquid component is supplied through the intake tube 132 into a chamber formed by the first cover 120, third cover 124, and the housing cavity 22. Preferably, the pump 10, is oriented so that the first crankshaft end portion 62 is located below second crankshaft end portion 64. When a substance having a liquid phase and a vapor phase, such as ammonia and water, enters the pump 10, this orientation of the pump 10 allows the liquid portion to accumulate in a lower portion of the pump 10 and the vapor portion to accumulate in an upper portion of the pump 10. Preferably, the magnetic member 110 is located above the level of liquid that accumulates in the pump 10 to reduce drag losses associated with rotating the magnetic member 110 in liquid.

Figure 16:
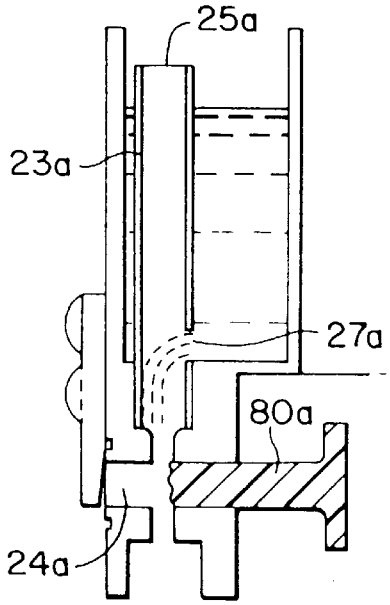
FIG. 16 is a partial cross sectional view showing how liquid and vapor enters an inlet tube shown in FIG. 1.

As partially shown in FIG. 16, liquid preferably accumulates around each intake tube 23*a*, 23*b*, and rises to a level preferably above the openings 27*a*, 27*b* and below the open ends 25*a*, 25*b*. This allows vapor to enter the inlet tubes 23*a*, 23*b* through the open ends 25*a*, 25*b*, while liquid enters the inlet tubes 23*a*, 23*b* through the openings 27*a*, 27*b*.

Openings 27*a*, 27*b* are orifices that establish the height of liquid stored in a chamber formed by the third cover 124, shown in FIG. 1. By restricting flow of liquid to the bores, the openings in the intake tubes cause liquid flowing from a source, such as an absorber, to accumulate in the pump chamber until it rises to a level where it flows at a normal rate into the bores. The pressure head and volume of the stored liquid serve to prevent vapor lock. If the inlet tubes were not present, vapor lock could prevent a low head of liquid from forcing liquid into the bores.

The inlet tubes allow for relatively continuous flow from the pump chamber into the bores. The liquid level in the intake tubes quickly builds up to produce a liquid head at each bore inlet 28*a*, 28*b*, 28*c*, and 28*d* that is much higher than normal to force liquid into bores. This allows even a small stream of liquid to enter the bores, thereby reversing any vapor lock affect and reestablishing normal pumping.

Openings 27*a*, 27*b* meter the flow of liquid into the inlet tubes 23*a*, 23*b* to maintain a relatively constant flow of liquid to the bores 24*a*, 24*b* if liquid flow to the pump 10 is interrupted, such as when flow from an absorber is temporarily delayed. In addition, the liquid entering the inlet tubes 23*a*, 23*b* via openings 27*a*, 27*b* mixes with the vapor entering the inlet tubes 23*a*, 23*b* via open ends 25*a*, 25*b* to ensure that a liquid-vapor mixture rather than alternating streams of pure vapor and liquid-vapor enters the bores 24*a*, 24*b* through inlets 28*a*, 28*b*.

Providing a supply of a liquid around the inlet tubes and mixing of liquid and vapor reduces the likelihood of vapor lock, and also allows for pumping at various rates and for pumping of substances having a wide range of concentrations of ammonia and various ratios of vapor to liquid. In addition, the mixing of the liquid and vapor creates many small vapor bubbles of varying sizes, which enter the bores 24*a*, 24*b*, 24*c*, and 24*d* with the liquid. During compression, the many sizes of bubbles in the bore collapse at different times instead of all together, or as one bubble. This softens the pressure spikes that could cause cylinder erosion.

Pumping is initiated by energizing the motor 134, shown in FIG. 1 or the electromagnetic stator 140 shown in FIG. 15. The magnetic coupling between the driving magnet 138 and magnetic member 110 or between the electromagnetic stator 140 and magnetic member 110' rotate magnetic member 110, 110' and causes the corresponding crankshaft 60, 60' to rotate about its axis of rotation E—E and thereby reciprocate the pistons 80*a*, 80*b*, 80*c*, and 80*d* in the bores 24*a*, 24*b*, 24*c*, and 24*d*.

When the crankshaft 60 rotates, coupling structure 90 moves in cavity 22 in a circular path about the crankshaft axis of rotation E—E without rotating. The moving coupling structure 90 causes each piston 80*a*, 80*b*, 80*c*, and 80*d* to reciprocate in its respective bore 24*a*, 24*b*, 24*c*, and 24*d*. Distally opposed pistons 80*a* and 80*b* or 80*c* and 80*d* reciprocate in phase with one another in that as one piston reaches top dead center proximate to an outlet, the piston opposite to it reaches a fully retracted position in the cavity 22.

As the pistons 80*a*, 80*b*, 80*c*, and 80*d* reciprocate within their bores 24*a*, 24*b*, 24*c*, and 24*d*, each travel during an intake stroke toward cavity 22 so that the piston heads 82*a*, 82*b*, 82*c*, and 82*d* open the inlets 28*a*, 28*b*, 28*c*, and 28*d* and allow solution to enter the bores 24*a*, 24*b*, 24*c*, and 24*d* via the inlet tubes, inlets 28*a*, 28*b*, 28*c*, and 28*d*, and optional auxiliary inlets, such as inlets 29*a* and 29*b*. When the pistons 80*a*, 80*b*, 80*c*, and 80*d* move in their discharge strokes, they travel toward outlets 26*a*, 26*b*, 26*c*, and 26*d* sealing the bores 24*a*, 24*b*, 24*c*, and 24*d* from fluid communication with the inlets 28*a*, 28*b*, 28*c*, and 28*d* and auxiliary inlets 29*a*, 29*b*. Increased fluid pressure generated in the bores 24*a*, 24*b*, 24*c*, and 24*d* causes valve structures, such as valve structures 100*a* and 100*b*, to flex away from housing 20 and allow solution in the bores 24*a*, 24*b*, 24*c*, and 24*d* to be ejected through the outlets 26*a*, 26*b*, 26*c*, and 26*d* when the pressure in each bore slightly exceeds the discharge pressure in discharge chamber 128, shown in FIG. 1. The ejected solution travels to discharge chamber 128 and is pumped through the discharge tube 130. When the pistons 80*a*, 80*b*, 80*c*, and 80*d* end their discharge stroke and begin the intake stroke, the valve structures close the outlets 26*a*, 26*b*, 26*c*, and 26*d* to prevent significant back flow into bores 24*a*, 24*b*, 24*c*, and 24*d*.

Preferably, the piston heads 82*a*, 82*b*, 82*c*, and 82*d* are virtually flush with the exterior surface of housing 20 when they are in their fully extended position. This ensures that bores 24*a*, 24*b*, 24*c*, and 24*d* are essentially emptied of any remaining liquid. Otherwise, such liquid, if allowed to remain in bores 24*a*, 24*b*, 24*c*, and 24*d*, could evaporate excessively as the pistons 80*a*, 80*b*, 80*c*, and 80*d* retract, and the vapor would decrease the pumping volume by displacing entering solution and thus tend to cause vapor lock. Preferably, piston heads 82*a*, 82*b*, 82*c*, and 82*d* do not extend past the external surface of the housing 20 as such would increase the tendency for the pistons 80*a*, 80*b*, 80*c*, and 80*d* to impact the valve structures.

As the solution continues to enter the pump 10, 10' through intake tube 132, the solution enters the passage 58, shown in FIGS. 1 and 7, and flows directly to the helical groove 74 shown in FIG. 1. In addition, some solution enters the cavity 22 and the area enclosed by the first cover 120. When the crankshaft 60 rotates, the helical grooves 73, 74, and 76 convey solution toward the second crankshaft end portion 64 to lubricate and cool bearing surfaces between the shaft sleeve 70 and first bearing sleeve 46, between the second crankshaft end portion 64 and the second bearing sleeve 56, and between the eccentric portion 66 and the slider block 92.

The use of multiple pistons also reduces the likelihood of vapor lock, because it is unlikely that all pistons will vapor-lock at one time. If one or two of the pistons do vapor-lock, the others continue pumping. Since the total liquid flow is less than maximum design flow under most operating conditions, the pistons not undergoing vapor lock preferably pump most, or perhaps all, of the inlet liquid flowing from a source, such as an absorber. This liquid flows through the pump and helps to prevent over heating of the vapor locked cylinders.

Figure 17:
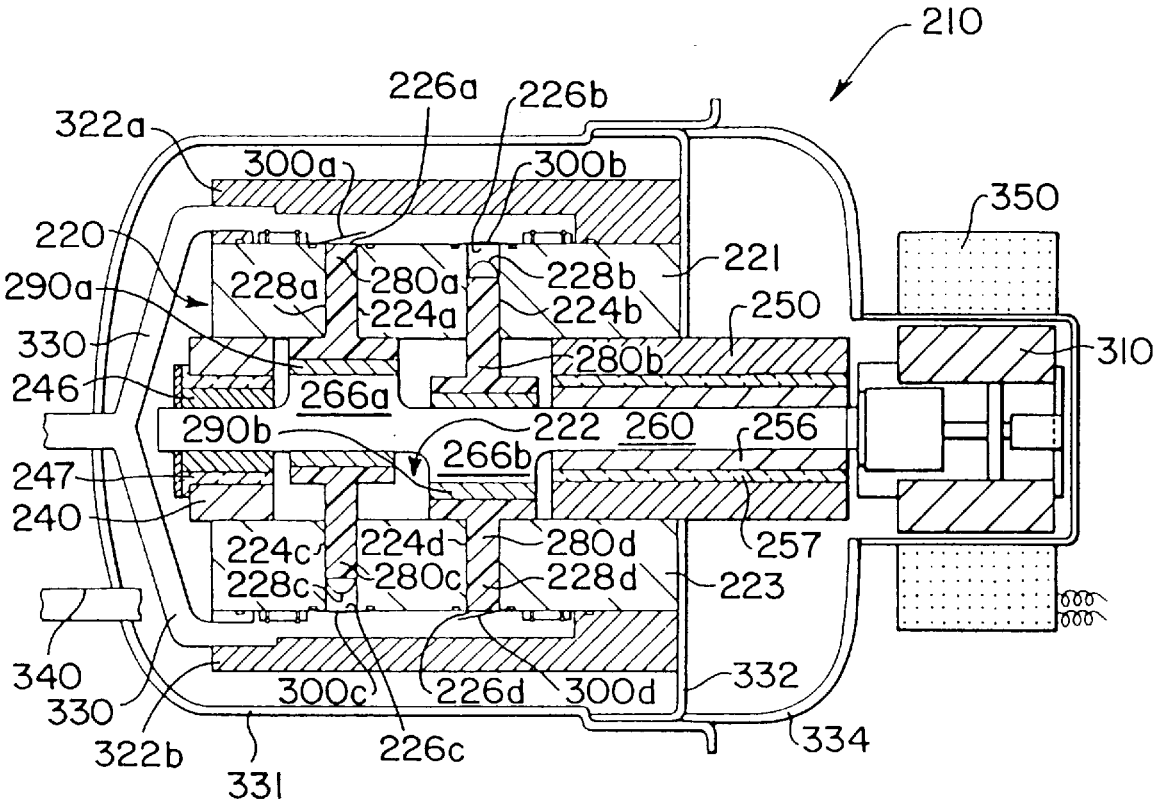
FIG. 17 is a partial cross sectional view of a third embodiment of the pump.
Figure 18:
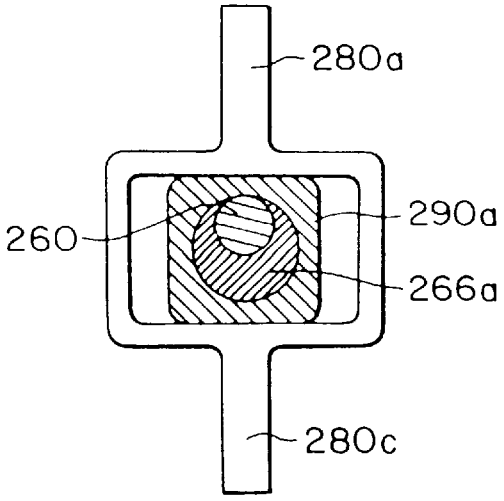
FIG. 18 is a partial cross sectional view of a crankshaft, eccentric portion, coupling structure, and integral pistons shown in FIG. 17.
Figure 19:
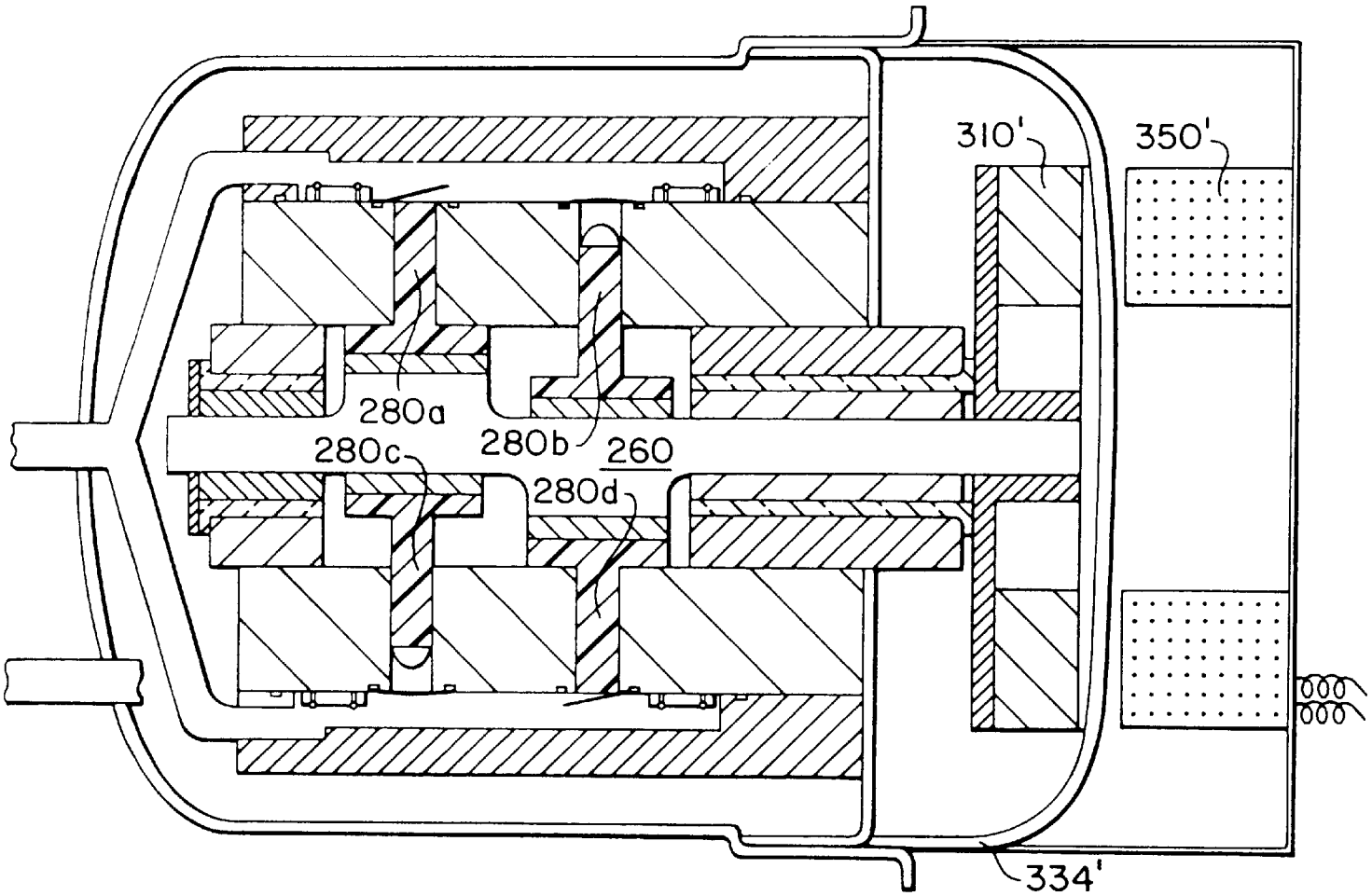
FIG. 19 is a partial cross sectional view of a fourth embodiment of the pump.

Other embodiments of the invention are shown in FIGS. 17–19. As shown in FIG. 17 a pump 210 includes a housing 220 having a pair of generally parallel body members 221 and 223 spaced apart to define a cavity 222 therebetween. The housing 220 also includes a first support 240 coupled to the body members 221 and 223 at one end portion of the housing 220, and a second support 250 coupled to the body members 221 and 223 at another end portion of the housing 220. Preferably, the body members 221 and 223, first support 240, and second support 250 each have a generally parallelepiped shape and rectangular shaped faces making each of these pieces relatively simple to manufacture with reduced machining.

As shown in FIG. 17, body members 221 and 223, first support 240, and second support 250 form a generally rectangular shaped frame. Although the body members 221 and 223 are preferably connected to the first and second supports 240 and 250 by means of welding, threaded bolts, or other connecting structures, the body members 221, 223, and first and second supports 240 and 250 may be formed integrally. Connecting some or all of the pieces of the housing 220 after assembly of the pumping components in the cavity 222 facilitates rapid and low cost assembly of the pump 210.

The body member 221 defines a pair of bores 224*a* and 224*b* extending from the cavity 222 and terminating at outlets 226*a* and 226*b*. Similarly, the body member 223 defines a pair of bores 224*c* and 224*d* extending from the cavity 222 and terminating at outlets 226*c* and 226*d*. As shown in FIG. 17, the bores 224*a* and 224*c* and the bores 224*b* and 224*d* are preferably opposed to one another in a coaxial fashion, however in another embodiment using pistons, 280*a*' and 280*c*', shown in FIG. 18*a*, the bores 224*a* and the bores 224*d* are offset from one another to reduce the likelihood of piston bending. Inlets 228*a* and 228*b* and inlets 228*c* and 228*d* formed respectively in body members 221 and 223 communicate with the bores 224*a*, 224*b*, 224*c*, and 224*d* at a position located between the cavity 222 and the outlets 226*a*, 226*b*, 226*c*, 226*d*. Preferably, auxiliary inlets (not shown) are also formed in the body members 221 and 223 and communicate with the bores 224*a*, 224*b*, 224*c*, and 224*d* in positions opposed to the inlets 228*a*, 228*b*, 228*c*, and 228*d*.

The pump 210 also includes a crankshaft 260 between the body members 221 and 223. The crankshaft 260 has a first end portion rotatably mounted in the first support 240 and a second end portion rotatably mounted in the second support 250. To support crankshaft 260 and reduce friction during rotation, a first bearing sleeve 247 and first journal sleeve 246 are preferably positioned between the first crankshaft end portion and the first support 240, and a second bearing sleeve 257 and second journal sleeve 256 are preferably positioned between the second crankshaft end portion and the second support 250. The bearing sleeves 247 and 257 are preferably made of the same types of lubricious materials as the bearing sleeves 46 and 56, described in connection with the embodiment shown in FIG. 1.

As shown in FIG. 17, the crankshaft 260 preferably has a first eccentric portion 266*a* and a second eccentric portion 266*b* disposed in the cavity 222 and facing in opposite directions from a rotational axis of the crankshaft 260. The eccentric portions 266*a* and 266*b* are either attached to the crankshaft 260 or formed integrally with the crankshaft 260. Because the eccentric portions 266*a* and 266*b* face in opposite directions from the crankshaft rotational axis, they help to balance the crankshaft 260 and reduce the need for counterweights.

As shown in FIGS. 17 and 18, the pump 210 includes a first coupling structure 290*a* having a bore receiving the first eccentric portion 266*a*, and a second coupling structure 290*b* having a bore receiving the second eccentric portion 266*b*. The pump 210 also includes pistons 280*a*, 280*b*, 280*c*, and 280*d* having respective bases disposed in the cavity 222 and heads disposed in bores 224*a*, 224*b*, 224*c*, and 224*d*. The bases of pistons 280*a* and 280*c* are coupled to the first coupling structure 290*a*, and the bases of pistons 280*b* and 280*d* are coupled to the second coupling structure 290*b*.

As shown in FIG. 18, the bases of pistons 280*a* and 280*c* are joined together and form a cavity for the first coupling structure 290*a*. Similarly the bases of pistons 280*b* and 280*d* are joined together and form a cavity for the second coupling structure 290*b*. Preferably, pistons 280*a* and 280*c* and pistons 280*b* and 280*d* are integrally formed of a flexible plastic material, such as the materials used to form the above-described pistons 80*a*–80*d*. Integrally forming the pistons 280*a* and 280*c* and pistons 280*b* and 280*d* facilitates orienting the pistons in the bores 224*a*, 224*b*, 224*c*, and 224*d* during assembly. In the embodiments of FIGS. 17–19, the coupling structures 290*a* and 290*b* are preferable slider blocks capable of sliding within the cavities formed by the pistons when the crankshaft 260 rotates.

In an alternate embodiment (not shown), the bases of pistons 280*a* and 280*c* are individually formed and clamped to the coupling structure 290*a*, and the bases of pistons 280*b* and 280*d* are individually formed and clamped to the coupling structure 290*b*. The integral pistons 280*a* and 280*c* and integral pistons 280*b* and 280*d* shown in FIG. 18 are preferred, however, because they do not require clamping structure.

Figure 18A:
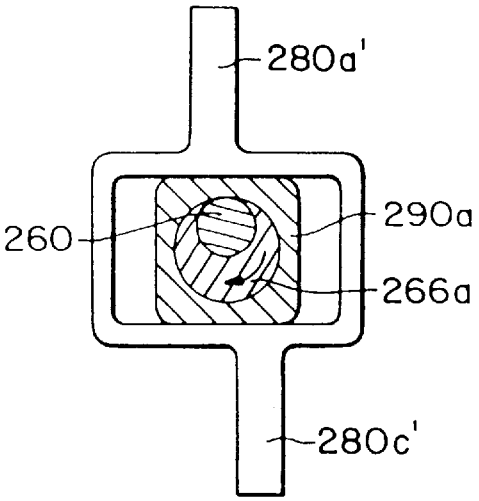
FIG. 18*a* is a partial cross sectional view of a crankshaft, eccentric portion, coupling structure, and integral positions for use with the pump shown in FIG. 17 when bores of the pump are offset.

As shown in FIG. 18*a*, opposed pistons 280*a*' and 280*c*' have piston heads offset from one another. The pistons 280*a*' and 280*c*' are used in an embodiment where the opposed bores in pump 210 are offset from one another. As shown in FIG. 18*a*, the heads of pistons 280*a*' and 280*c*' are offset counter-clockwise from radial lines extending from an axis of rotation of crankshaft 260, and the crankshaft 260 preferably rotates in a clockwise direction. Offset bores in pump 210 reduce the likelihood of piston bending.

Rotation of the crankshaft 260 reciprocates the heads of pistons 280*a*, 280*b*, 280*c*, and 280*d* in the respective bores 224*a*, 224*b*, 224*c*, and 224*d*. During the intake strokes, the piston heads respectively move toward cavity 222 and allow flow into the bores 224*a*, 224*b*, 224*c*, and 224*d* via the inlets 228*a*, 228*b*, 228*c*, and 228*d*. During a discharge stroke, the piston heads respectively seal the inlets 228*a*, 228*b*, 228*c*, and 228*d* and pump substances from the bores 224*a*, 224*b*, 224*c*, and 224*d* via outlets 226*a*, 226*b*, 226*c*, and 226*d*. The piston heads respectively travel all the way to the outlets 226*a*, 226*b*, 226*c*, and 226*d* to empty liquid from the bores 224*a*, 224*b*, 224*c*, and 224*d*.

Valve structures 300*a* and 300*b* and valve structures 300*c* and 300*d* are respectively mounted to the body members 221 and 223. The valve structures 300*a*, 300*b*, 300*c*, and 300*d* are preferably flexible leaf valves or reed valves that open in response to increased pressure in the bores 224*a*, 224*b*, 224*c*, and 224*d*. The valve structures 300*a*, 300*b*, 300*c*, and 300*d* are biased to close the bore outlets 226*a*, 226*b*, 226*c*, and 226*d* during the intake stroke.

Discharge housings 322*a* and 322*b* are respectively attached to outer surfaces of body members 221 and 223 and spaced from the valve structures 300*a*, 300*b*, 300*c*, and 300*d* to provide separate discharge chambers for pumped substances passing from the bore outlets 226*a*, 226*b*, 226*c*, and 226*d*. As shown in FIG. 17, discharge tubing 330 communicates with the chambers formed by the discharge housings 322*a* and 322*b* to remove pumped substances.

The pump 210 further includes a magnetic member 310 mounted to the second end portion of the crankshaft 260. The magnetic member 310 allows the crankshaft 260 to be rotated via a magnetic coupling.

A casing hermetically isolates the pump 210. The casing includes a first cover 331, bracket 332, and second cover 334. The first cover 331 partially surrounds the housing 220 and includes an intake pipe 340 for allowing flow of substances into the casing. The intake pipe may instead be connected to second covering 334. The discharge tubing 330 coupled to the discharge housings 322*a* and 322*b* passes in a sealed fashion through the first cover 331.

The bracket 332 is connected to the housing 220 and welded to the first cover 331 to support the housing 220 in the casing. The second cover 334 is welded to the first cover 331. The second cover 334 partially encloses a portion of the housing 222 and the magnetic member 310. The first cover 331 and second cover 334 are preferably hermetically sealed to form a chamber for collecting substances flowing to the pump 210 via the intake pipe 340.

In the embodiment of FIG. 17, an electromagnetic stator 350 is press fit or mounted onto the second cover 334. The electromagnetic stator 350 acts in response to electrical input to generate a magnetic field capable of rotating the magnetic member 310 and crankshaft 260. Preferably, the magnetic coupling is radial, as shown in FIG. 17. However other magnetic couplings are also possible. For example, the magnetic coupling can be axial by mounting an electromagnetic stator 350', shown in FIG. 19, on an end portion of a second cover 334' and magnetically coupling the electromagnetic stator with a magnetic member 310'. In addition, a motor and driving magnet (not shown) could be used to rotate the crankshaft 260.

Although the embodiments shown in FIGS. 1–19 include one or two crankshaft eccentric portions and four pistons, the present invention could be practiced with any number of eccentric portions or pistons, including, for example, a single piston or eight pistons. Each of the above-described embodiments are particularly suited for pumping mixtures of ammonia and water. However, the invention could be practiced to pump many different types of substances. In addition, the invention could be practiced without a magnetic coupling for rotating the crankshaft.

It will be apparent to those skilled in the art that various modifications and variations can be made to the structure and methodology of the present invention without departing from the scope or spirit of the invention. In view of the foregoing, it is intended that the present invention cover modifications and variations of this invention provided they fall within the scope of the following claims and their equivalents.

We claim:

1. A pump comprising:

a crankshaft having opposite end portions and an eccentric portion between the end portions;

a housing defining a cavity, an outlet, at least one bore extending between the cavity and the outlet, and at least one inlet communicating with the bore and with an inlet chamber, the eccentric portion of the crankshaft being in the cavity and the end portions of the crankshaft being rotatably coupled to the housing;

a piston having a base disposed in the cavity and a head disposed in the bore, the base of the piston being coupled to the eccentric portion of the crankshaft such that rotation of the eccentric portion in the cavity reciprocates the piston head in the bore to provide discharge from the bore through the outlet and intake to the bore through the inlet;

a valve structure disposed to open and close the outlet in response to movement of the piston head during the discharge and the intake;

a magnetic member coupled to the crankshaft for magnetically coupling the crankshaft with an external magnetic field capable of rotating the crankshaft;

at least one cover containing the magnetic member and defining the inlet chamber; and an electromagnetic stator mounted to the cover, the electromagnetic stator being magnetically coupled to the magnetic member to rotate the magnetic member and the crankshaft.

2. The pump of claim 1, wherein the bore is offset such that the axis of the bore is generally parallel to a line extending from the axis of rotation of the crankshaft in a plane perpendicular to the axis of rotation.

3. The pump of claim 1, wherein the inlet communicates with the bore at a position intermediate to the cavity and the outlet.

4. The pump of claim 1, wherein the housing defines an auxiliary bore and at least one inlet and an outlet communicating with the auxiliary bore, the auxiliary bore having an axis parallel to the axis of the at least one bore and lacking intersection with the rotational axis of the crank shaft, and wherein the pump further comprises an additional piston having a head disposed in the auxiliary bore and a base coupled to the eccentric portion of the crankshaft such that rotation of the eccentric portion in the cavity reciprocates the auxiliary piston head in the auxiliary bore to provide discharge from the auxiliary bore and intake to the auxiliary bore.

5. The pump of claim 4, wherein the housing defines two opposed inlets for each of the bores.

6. The pump of claim 1, wherein the housing defines first and second pairs of bores and inlets and outlets communicating with the bores, the first pair of bores having parallel axes lacking intersection with the rotational axis of the crankshaft and the second pair of bores having parallel axes lacking intersection with the rotational axis of the crankshaft, and wherein the pump further comprises pistons each having a head disposed in one of the bores and a base coupled to the eccentric portion of the crankshaft.

7. The pump of claim 1 wherein the head of the piston reaches the outlet during discharge such that the piston completely empties liquid from the bore.

8. The pump of claim 1 wherein the valve structure comprises a flexible, resilient leaf valve fixed to the housing and biased to close the outlet, the leaf valve being movable in response to fluid pressure in the bore generated by movement of the piston head during discharge.

9. The pump of claim 1, wherein the head of the piston includes an annular groove allowing a portion of the head to expand in the bore in response to fluid pressure in the bore.

10. The pump of claim 1, wherein the piston is made of plastic material capable of slight elastic deformation such that the piston absorbs pressure increases in the bore.

11. The pump of claim 1, further comprising a first support connected to one end of the housing, a second support connected to another end of the housing, a first bearing sleeve disposed in the first support, and a second bearing sleeve disposed in the second support, the end portions of the crankshaft being rotatably mounted in the first and second bearing sleeves.

12. The pump of claim 11, wherein each of the end portions of the crankshaft includes a helical groove for conveying fluid between the crankshaft and the first and second bearing sleeves.

13. The pump of claim 1, further comprising a coupling structure having a crankshaft bore rotatably receiving the eccentric portion of the crankshaft and being coupled to the piston base.

14. The pump of claim 13 wherein the eccentric portion of the crankshaft includes a helical groove for conveying fluid between the crankshaft and the coupling structure.

15. The pump of claim 13 wherein the coupling structure includes a slider block and a ledge extending above a surface of the slider block, the crankshaft bore passing through the slider block, and the base of the piston being slidably positioned between the ledge and the surface of the slider block.

16. The pump of claim 15 wherein the base of the piston is round such that the piston base is capable of rotating on the surface of the slider block.

17. The pump of claim 13 wherein the coupling structure has a retainer heat shrunk onto the slider block, the ledge being a portion of the retainer.

18. The pump of claim 1, wherein the bore is offset such that an axis of the bore lacks intersection with an axis of rotation of the crankshaft.

19. The pump of claim 1, wherein the magnetic member is formed of material resistant to corrosion caused by exposure to solutions of ammonia in water.

20. The pump of claim 19, wherein the magnetic member is formed of a material selected from ceramic, ferrite, and metal.

21. A pump comprising;

a crankshaft having opposite end portions and an eccentric portion between the end portions;

a housing defining a cavity, an outlet, at least one bore extending between the cavity and the outlet, and at least one inlet communicating with the bore and with an inlet chamber, the eccentric portion of the crankshaft being in the cavity and the end portions of the crankshaft being rotatably coupled to the housing;

a piston having a base disposed in the cavity and a head disposed in the bore, the base of the piston being coupled to the eccentric portion of the crankshaft such that rotation of the eccentric portion in the cavity reciprocates the piston head in the bore to provide discharge from the bore through the outlet and intake to the bore through the inlet;

a valve structure disposed to open and close the outlet in response to movement of the piston head during the discharge and the intake;

a magnetic member coupled to the crankshaft for magnetically coupling the crankshaft with an external magnetic field capable of rotating the crankshaft;

at least one cover containing the magnetic member and defining the inlet chamber;

an electromagnetic stator mounted to the cover, the electromagnetic stator being magnetically coupled to the magnetic member to rotate the magnetic member and the crankshaft; and an inlet tube extending from the bore communicating inlet, the inlet tube having at least one hole positioned along the length thereof, the hole permitting liquid to flow into the inlet tube and mix with vapor in the inlet tube.

22. A pump comprising:

a housing including a first body member and a second body member spaced from the first body member so that the first and second body members form a cavity therebetween, the housing defining an outlet, at least one bore extending between the cavity and the outlet, and at least one inlet communicating with the bore;

a first support connected to the first and second body members at one end portion of the housing;

a second support connected to the first and second body members at another end portion of the housing;

a crankshaft having a first end portion rotatably mounted in the first support, a second end portion rotatably mounted in the second support, and at least one eccentric portion disposed in the cavity;

a piston having a base disposed in the cavity and a head disposed in the bore for reciprocation between a discharge position proximate the outlet and an intake position allowing flow to the bore through the inlet;

a coupling structure having a crankshaft bore rotatably receiving the eccentric portion of the crankshaft, the coupling structure being coupled to the piston base such that rotation of the eccentric portion in the cavity reciprocates the piston head in the housing bore;

a valve structure disposed to open and close the outlet in response to movement of the piston head from the discharge position to the intake position; and a magnetic member coupled to the crankshaft for magnetically coupling the crankshaft with an external magnetic field capable of rotating the crankshaft.

23. The pump of claim 22, further comprising at least one cover enclosing the magnetic member, and an electromagnetic stator mounted to the cover, the electromagnetic stator being magnetically coupled to the magnetic member to rotate the magnetic member and the crankshaft.

24. The pump of claim 22, further comprising at least one cover enclosing the magnet member, and a motor mounted to the cover, the motor having a rotatable drive shaft and a driving magnetic coupled to the drive shaft, the driving magnet being magnetically coupled to the magnetic member such that rotation of the driving magnet rotates the magnetic member and the crankshaft.

25. The pump of claim 22, wherein the housing defines two opposed inlets for the bore.

26. The pump of claim 22, wherein the housing defines first and second pairs of bores and inlets and outlets communicating with the bores, and wherein the pump further comprises pistons each having a head disposed in one of the bores and a base coupled to the crankshaft.

27. The pump of claim 22, further comprising an inlet tube extending from the bore communicating inlet, the inlet tube having at least one hole positioned along the length thereof, the hole permitting liquid to flow into the inlet tube and mix with vapor in the inlet tube.

28. The pump of claim 22 wherein the head of the piston reaches the outlet during discharge such that the piston completely empties liquid from the bore.

29. The pump of claim 22, wherein the valve structure comprises a flexible, resilient leaf valve fixed to the housing and biased to close the outlet, the leaf valve being movable in response to fluid pressure in the bore generated by movement of the piston head during discharge.

30. The pump of claim 22, wherein the head of the piston includes an annular groove allowing a portion of the head to expand in the bore in response to fluid pressure in the bore.

31. The pump of claim 22, wherein the piston is made of plastic material capable of slight elastic deformation such that the piston absorbs pressure increases in the bore.

32. The pump of claim 22, wherein the coupling structure includes a slider block and a ledge extending above a surface of the slider block, the crankshaft bore passing through the slider block, and the base of the piston being slidably positioned between the ledge and the surface of the slider block.

33. The pump of claim 32, wherein the base of the piston is round such that the piston base is capable of rotating on the surface of the slider block.

34. The pump of claim 32, wherein the coupling structure has a retainer heat shrunk onto the slider block, the ledge being a portion of the retainer.

35. The pump of claim 22, wherein the first and second body members and the first and second supports form a generally rectangular shaped frame.

36. The pump of claim 22, wherein the first and second body members are integrally formed with the first and second supports.

37. The pump of claim 22, wherein the first and second body members each define at least one bore, and at least one inlet and an outlet communicating with the bore, and wherein the pump further comprises a first piston having a head disposed in the bore of the first body member and a second piston having a head disposed in the bore of the second body member, the first and second pistons having a base coupled to the coupling structure.

38. The pump of claim 37, wherein the first piston is integrally formed with the second piston.

39. The pump of claim 38, wherein the coupling structure includes a slider block having the crankshaft bore passing therethrough, the slider block being movable in a cavity formed by the first and second piston bases.

40. The pump of claim 22, wherein the housing defines first and second bores, and at least one inlet and an outlet for each of the bores, the crank shaft including a first eccentric portion and a second eccentric portion, and wherein the pump further comprises a first piston having a base disposed in the cavity and a head disposed in the first bore, a second piston having a base disposed in the cavity and a head disposed in the second bore, a first coupling structure having a crankshaft bore rotatably receiving the first eccentric portion of the crankshaft, the first coupling structure being coupled to the base of the first piston, and a second coupling structure having a crankshaft bore rotatably receiving the second eccentric portion of the crankshaft, the second coupling structure being coupled to the base of the second piston.

41. The pump of claim 40, wherein the housing defines third and fourth bores, and wherein the pump further comprises a third piston having a base coupled to the first coupling structure and a head disposed in the third bore, and a fourth piston having a base coupled to the second coupling structure and a head disposed in the fourth bore.

42. The pump of claim 22, further comprising a first bearing sleeve between the first support and the first end portion of the crankshaft, and a second bearing sleeve between the second support and the second end portion of the crankshaft.

43. The pump of claim 22, wherein the inlet communicates with the bore intermediate the cavity and the outlet.

44. A pump comprising;

a crankshaft having opposite end portions and an eccentric portion between the end portions;

a housing defining a cavity, an outlet, at least one bore extending between the cavity and the outlet, and at least one inlet communicating with the bore, the eccentric portion of the crankshaft being in the cavity and the end portions of the crankshaft being rotatably coupled to the housing, the housing including a first body member, a second body member spaced from the first body member so that the first and second body members form the cavity therebetween, a first support connected to the first and second body members at one end portion of the housing, and a second support connected to the first and second body members at the other end portion of the housing.

a piston having a base disposed in the cavity and a head disposed in the bore, the base of the piston being coupled to the eccentric portion of the crankshaft such that rotation of the eccentric portion in the cavity reciprocates the piston head in the bore to provide discharge from the bore through the outlet and intake to the bore through the inlet;

a valve structure disposed to open and close the outlet in response to movement of the piston head during the discharge and the intake;

a magnetic member coupled to the crankshaft for magnetically coupling the crankshaft with an external magnetic field capable of rotating the crankshaft;

at least one cover containing the magnetic member;

an electromagnetic stator mounted to the cover, the electromagnetic stator being magnetically coupled to the magnetic member to rotate the magnetic member and the crankshaft.

45. A pump comprising:

a crankshaft having opposite end portions and an eccentric portion between the end portions;

a housing defining a cavity, at least one bore extending from the cavity, at least one inlet communicating with the bore, and at least one outlet communicating with the bore, the eccentric portion of the crankshaft being in the cavity and the end portions of the crankshaft being coupled to the housing so that the crankshaft is capable of rotating in the housing;

a piston having a base disposed in the cavity and a head disposed in the bore, the base of the piston being coupled to the eccentric portion of the crankshaft such that rotation of the eccentric portion in the cavity reciprocates the piston head in the bore to provide discharge from the bore and intake to the bore;

a valve structure disposed to open and close the outlet in response to movement of the piston head during the discharge and the intake;

a magnetic member coupled to the crankshaft for magnetically coupling the crankshaft with an external magnetic field capable of rotating the crankshaft; and a casing having an interior for containing the housing and fluid, the casing including an outlet tube in fluid communication with the outlet of the housing and an inlet tube in fluid communication with the interior of the casing so that fluid flowing in the inlet tube flows into the interior of the casing, the inlet of the housing being in fluid communication with the interior of the casing to allow for flow of the fluid from the interior of the casing to the bore.

46. The pump of claim 45, further comprising an electromagnetic stator mounted to the casing, the electromagnetic stator being magnetically coupled to the magnetic member to rotate the magnetic member and the crankshaft.

47. The pump of claim 45, further comprising a motor mounted to the casing, the motor having a rotatable driveshaft and a driving magnet coupled to the drive shaft, the driving magnet being magnetically coupled to the magnetic member such that rotation of the driving magnet rotates the magnetic member and the crankshaft.

48. The pump of claim 45, wherein the housing defines an auxiliary bore and wherein the pump further comprises an auxiliary piston having a head disposed in the auxiliary bore and a base coupled to the eccentric portion of the crankshaft.

49. The pump of claim 48, wherein the bores are coaxial.

50. The pump of claim 48, wherein the bores are offset such that axes of the bores are parallel and lack intersection with an axis of rotation of the crankshaft.

51. The pump of claim 48, further comprising a coupling structure having a crankshaft bore rotatably receiving the eccentric portion of the crankshaft and being coupled to the bases of the pistons.

52. The pump of claim 48, wherein the pistons are integrally formed together.

53. The pump of claim 52, wherein the bases of the pistons define a slider block cavity, and wherein the pump further comprises a slider block slidable in the slider block cavity, the slider block having a crankshaft bore rotatably receiving the eccentric portion of the crankshaft.

54. The pump of claim 53, wherein the eccentric portion of the crankshaft includes a helical groove for conveying fluid between the crankshaft and the slider block.

55. The pump of claim 45, wherein the valve structure comprises a flexible, resilient leaf valve fixed to the housing and biased to close the outlet, the leaf valve flexing in response to fluid pressure in the bore generated by movement of the piston head during discharge.

56. The pump of claim 45, wherein the head of the piston includes an annular lip extending from an end of the piston, the lip allowing a portion of the head to expand in the bore in response to fluid pressure in the bore.

57. The pump of claim 45, further comprising a first bearing sleeve disposed in a first end portion of the housing, and a second bearing sleeve disposed in a second end portion of the housing, the end portions of the crankshaft being rotatably mounted in the first and second bearing sleeves.

58. The pump of claim 57, wherein each of the end portions of the crankshaft includes a helical groove for conveying fluid between the crankshaft and the first and second bearing sleeves.

59. The pump of claim 45, wherein the inlet communicates with the bore at a position intermediate to the cavity and the outlet.

60. The pump of claim 45, wherein the housing includes a first body member and a second body member defining the cavity therebetween.

61. The pump of claim 60, wherein the first and second body members each define at least one bore, and wherein the pump further comprises a first piston having a head disposed in the bore of the first body member and a second piston having a head disposed in the bore of the second body member, each of the first and second pistons having a base coupled to the eccentric portion of the crankshaft.

62. The pump of claim 61, wherein the first piston is integrally formed with the second piston.

63. The pump of claim 62, wherein the bases of the pistons define a slider block cavity, and wherein the pump further comprises a slider block slidable in the slider block cavity, the slider block having a crankshaft bore rotatably receiving the eccentric portion of the crankshaft.

64. The pump of claim 63, wherein the eccentric portion of the crankshaft includes a helical groove for conveying fluid between the crankshaft and the slider block.

65. The pump of claim 61, further comprising a first bearing sleeve disposed in a first end portion of the housing, and a second bearing sleeve disposed in a second end portion of the housing, the end portions of the crankshaft being rotatably mounted in the first and second bearing sleeves.

66. The pump of claim 65, wherein each of the end portions of the crankshaft includes a helical groove for conveying fluid between the crankshaft and the first and second bearing sleeves.

67. A pump comprising:

a crankshaft having opposite end portions and an eccentric portion between the end portions;

a housing defining a cavity, an outlet, at least one bore extending between the cavity and the outlet, and at least one inlet communicating with the bore, the eccentric portion of the crankshaft being in the cavity and the end portions of the crankshaft being rotatably coupled to the housing;

a piston having a base disposed in the cavity and a head disposed in the bore, the base of the piston being coupled to the eccentric portion of the crankshaft such that rotation of the eccentric portion in the cavity reciprocates the piston head in the bore to provide discharge from the bore and intake to the bore;

a valve structure disposed to open and close the outlet in response to movement of the piston head during the discharge and the intake; and an inlet tube extending from the bore communicating inlet, the inlet tube having a first opening and at least one second opening positioned along the length thereof, the first opening permitting vapor to flow into the inlet tube and the second opening permitting liquid to flow into the inlet tube and mix with the vapor in the inlet tube.

68. The pump of claim 67, further comprising a magnetic member coupled to the crankshaft for magnetically coupling the crankshaft with an external magnetic field capable of rotating the crankshaft.

69. The pump of claim 67, further comprising a casing having an interior for containing at least the liquid and the vapor, the first and second openings on the inlet tube being in flow communication with the interior of the casing.

70. A pump comprising:

a crankshaft having opposite end portions and an eccentric portion between the end portions;

a housing defining a cavity, a first outlet, a first bore extending from the cavity to the first outlet in a first direction, at least one first inlet communicating with the first bore, a second outlet, a second bore extending from the cavity to the second outlet in a second direction opposite to the first direction, and at least one second inlet communicating with the second bore, the eccentric portion of the crankshaft being in the cavity and the end portions of the crankshaft being rotatably coupled to the housing;

a first piston having a first head disposed in the first bore and a first base coupled to the eccentric portion of the crankshaft such that rotation of the eccentric portion in the cavity reciprocates the first head in the first bore to provide discharge from the first bore and intake to the first bore;

a second piston having a second head disposed in the second bore and a second base coupled to the eccentric portion of the crankshaft such that rotation of the eccentric portion in the cavity reciprocates the second head in the second bore to provide discharge from the second bore and intake to the second bore, wherein the first and second pistons are integrally formed into a unitary, one piece construction;

a first valve structure disposed to open and close the first outlet in response to movement of the first head; and a second valve structure disposed to open and close the second outlet in response to movement of the second head.

71. The pump of claim 70, wherein the first and second bases define a slider block cavity and wherein the coupling structure includes a slider block in the slider block cavity, the slider block having a crankshaft bore receiving the eccentric portion of the crankshaft therein.

72. The pump of claim 70, further comprising a magnetic member coupled to the crankshaft for magnetically coupling the crankshaft with an external magnetic field capable of rotating the crankshaft.

73. The pump of claim 70, wherein the first and second bores are coaxial.

74. The pump of claim 70, wherein the first and second bores are offset such that an axis of the first bore lacks intersection with an axis of rotation of the crankshaft and an axis of the second bore lacks intersection with the axis of rotation of the crankshaft.

* * * * *